US009472125B2

(12) United States Patent
Debrody et al.

(10) Patent No.: US 9,472,125 B2
(45) Date of Patent: Oct. 18, 2016

(54) REUSABLE BOLT ELECTRONIC SEAL MODULE WITH GPS/CELLULAR PHONE COMMUNICATIONS AND TRACKING SYSTEM

(75) Inventors: Robert Debrody, Wayne, NJ (US); Donald Ruth, Newton, NJ (US); George Lundberg, Pompton Plains, NJ (US); Richard Dreisbach, Lafayette, NJ (US)

(73) Assignee: E.J. BROOKS COMPANY, Angola, IN (US)

( * ) Notice: Subject to any disclaimer, the term of this patent is extended or adjusted under 35 U.S.C. 154(b) by 1003 days.

(21) Appl. No.: 13/110,313

(22) Filed: May 18, 2011

(65) Prior Publication Data

US 2011/0273852 A1 Nov. 10, 2011

Related U.S. Application Data

(63) Continuation-in-part of application No. 12/239,869, filed on Sep. 29, 2008.

(60) Provisional application No. 60/997,858, filed on Oct. 5, 2007.

(51) Int. Cl.
*G09F 3/03* (2006.01)

(52) U.S. Cl.
CPC ..... *G09F 3/0376* (2013.01); *G09F 3/03* (2013.01); *G09F 3/0317* (2013.01); *G09F 3/0335* (2013.01)

(58) Field of Classification Search
CPC ..... G09F 3/03; G09F 3/0305; G09F 3/0317; G09F 3/0329; G09F 3/0335; G09F 3/0376
USPC ..... 292/322–324, 307 A, 307 B, 329; 340/5.7, 551, 545.6
See application file for complete search history.

(56) References Cited

U.S. PATENT DOCUMENTS 3,093,761 A * 6/1963 Case ..... 310/28
3,951,443 A * 4/1976 Barnaby ..... E05B 39/02 292/302

(Continued)

FOREIGN PATENT DOCUMENTS

DE 10322648 A1 * 12/2004
WO WO 2006074518 A1 * 7/2006

OTHER PUBLICATIONS

"Mobile phone tracking", Wikipedia.

(Continued)

*Primary Examiner* — Alyson M Merlino
(74) *Attorney, Agent, or Firm* — Gardner, Linn, Burkhart & Flory, LLP

(57) ABSTRACT

An electronics circuit first portion is entirely within an electronics module housing, sensing and transmitting a tamper condition of a normally locked bolt. The bolt comprises a second portion of the electronics circuit. The seal electronics circuit first portion comprises a seal monitoring, tracking and communications system. The bolt passes through the module housing and is secured with a locking device external the module such that the module is reusable when the bolt is severed. The bolt and module housing include a cooperative contamination sealing arrangement for sealing the bolt to the housing. The electronics circuit first portion includes RFID tamper detection circuitry, GPS, Wi Fi and cell phone communication and tracking technologies. The cell phone technology tracks the seal using cell phone towers and Wi Fi access points and communicates the seal tracked position and seal status data to a cell phone communications center.

18 Claims, 16 Drawing Sheets

(56) References Cited

U.S. PATENT DOCUMENTS

| | | | | |
|---|---|---|---|---|
| 4,626,009 | A * | 12/1986 | Burnett et al. | 292/327 |
| 4,802,700 | A * | 2/1989 | Stevenson et al. | 292/327 |
| 5,005,883 | A * | 4/1991 | Guiler | 292/327 |
| 5,127,687 | A * | 7/1992 | Guiler | 292/327 |
| 5,152,650 | A * | 10/1992 | Kitagawa | 411/82.5 |
| 5,347,689 | A * | 9/1994 | Georgopoulos et al. | 24/136 R |
| 5,413,393 | A * | 5/1995 | Georgopoulos et al. | 292/327 |
| 5,774,056 | A * | 6/1998 | Berry et al. | 340/607 |
| 6,069,563 | A * | 5/2000 | Kadner et al. | 340/571 |
| 6,097,306 | A * | 8/2000 | Leon et al. | 340/5.1 |
| 6,265,973 | B1 * | 7/2001 | Brammall et al. | 340/568.1 |
| 6,357,266 | B1 * | 3/2002 | Van Buren | 70/56 |
| 6,407,666 | B1 * | 6/2002 | Debrody et al. | 340/568.4 |
| 6,464,269 | B1 | 10/2002 | Wilhelm et al. | |
| 6,550,829 | B1 | 4/2003 | Dobson | |
| 6,747,558 | B1 * | 6/2004 | Thorne et al. | 340/551 |
| 6,778,083 | B2 * | 8/2004 | Auerbach et al. | 340/539.1 |
| 6,791,465 | B2 * | 9/2004 | Blagin et al. | 340/665 |
| 6,962,376 | B2 * | 11/2005 | Palzkill et al. | 292/327 |
| 7,042,354 | B2 * | 5/2006 | Auerbach et al. | 340/539.31 |
| 7,098,784 | B2 | 8/2006 | Easley et al. | |
| 7,178,841 | B1 * | 2/2007 | Moreno | G09F 3/0305 24/136 L |
| 7,226,095 | B2 * | 6/2007 | Huang | F16B 2/248 292/323 |
| 7,239,238 | B2 * | 7/2007 | Tester et al. | 340/539.31 |
| 7,336,170 | B2 * | 2/2008 | Auerbach et al. | 340/539.31 |
| 7,375,619 | B2 * | 5/2008 | Auerbach et al. | 340/426.15 |
| 7,400,247 | B2 * | 7/2008 | Hopman et al. | 340/545.2 |
| 7,411,495 | B2 * | 8/2008 | Auerbach et al. | 340/539.26 |
| 7,438,339 | B2 * | 10/2008 | Abraham | 296/65.09 |
| 7,557,706 | B2 * | 7/2009 | Brown | 340/571 |
| 7,597,253 | B2 * | 10/2009 | Lin et al. | 235/382 |
| 7,649,455 | B2 | 1/2010 | Easley et al. | |
| 7,702,358 | B2 | 4/2010 | Meyers | |
| 7,740,292 | B1 * | 6/2010 | Fattori et al. | 292/307 R |
| 7,828,342 | B2 * | 11/2010 | Terry et al. | 292/327 |
| 7,828,343 | B2 * | 11/2010 | Terry et al. | 292/327 |
| 7,828,344 | B2 * | 11/2010 | Terry et al. | 292/327 |
| 7,828,345 | B2 * | 11/2010 | Terry et al. | 292/327 |
| 7,828,346 | B2 * | 11/2010 | Terry et al. | 292/327 |
| 7,884,711 | B2 | 2/2011 | Bao et al. | |
| 7,916,016 | B2 * | 3/2011 | Auerbach et al. | 340/539.26 |
| 7,990,270 | B2 * | 8/2011 | Mostov | 340/572.1 |
| 8,058,985 | B2 * | 11/2011 | Dobson et al. | 340/539.1 |
| 8,666,664 | B2 * | 3/2014 | Chiu | G08B 13/06 340/426.24 |
| 2004/0041705 | A1 * | 3/2004 | Auerbach et al. | 340/539.22 |
| 2004/0113782 | A1 * | 6/2004 | Auerbach et al. | 340/568.1 |
| 2005/0195101 | A1 * | 9/2005 | Stevens et al. | 342/28 |
| 2005/0206520 | A1 * | 9/2005 | Decker et al. | 340/539.22 |
| 2006/0055552 | A1 * | 3/2006 | Chung et al. | 340/686.1 |
| 2006/0109111 | A1 * | 5/2006 | Auerbach et al. | 340/539.31 |
| 2006/0152366 | A1 * | 7/2006 | Sironi et al. | 340/572.1 |
| 2006/0170560 | A1 * | 8/2006 | Auerbach et al. | 340/572.9 |
| 2007/0007776 | A1 * | 1/2007 | Beard | E05B 39/02 292/327 |
| 2008/0094173 | A1 * | 4/2008 | Zhou | G09F 3/0335 340/5.7 |
| 2008/0218353 | A1 * | 9/2008 | Fellows et al. | 340/572.6 |
| 2008/0229792 | A1 * | 9/2008 | Maple et al. | 70/275 |
| 2009/0066503 | A1 | 3/2009 | Lin | |
| 2009/0072554 | A1 | 3/2009 | Arguin | |
| 2009/0102652 | A1 * | 4/2009 | Diener et al. | 340/545.6 |
| 2009/0121877 | A1 * | 5/2009 | Henderson | E05B 39/02 340/572.7 |
| 2009/0179757 | A1 * | 7/2009 | Cohn | G09F 3/0376 340/542 |
| 2009/0210098 | A1 * | 8/2009 | Nielsen et al. | 700/283 |
| 2009/0322510 | A1 * | 12/2009 | Berger et al. | 340/539.1 |
| 2010/0013635 | A1 * | 1/2010 | Berger | G08B 13/08 340/542 |
| 2010/0117802 | A1 | 5/2010 | Easley et al. | |
| 2010/0332359 | A1 * | 12/2010 | Powers et al. | 705/28 |
| 2011/0037591 | A1 | 2/2011 | Easley et al. | |
| 2011/0246067 | A1 * | 10/2011 | Markham et al. | 701/210 |

OTHER PUBLICATIONS

"Peer-to-peer wireless positioning", Navizon.com.
"Mobile Navigator iPhone", Navigon.com.

* cited by examiner

REUSABLE BOLT ELECTRONIC SEAL MODULE WITH GPS/CELLULAR PHONE COMMUNICATIONS AND TRACKING SYSTEM

This application claims the benefit of U.S. Provisional Application Ser. No. 60/997,858 filed Oct. 5, 2007 in the name of Robert Debrody et al. and is a continuation-in-part of commonly owned U.S. utility application Ser. No. 12/239,869 filed Sep. 29, 2008 in the name of Robert Debrody et al., both of which applications are incorporated by reference herein in their entirety.

This invention relates to electronic security seals of the type including a bolt and a locking body for securing a hasp of a container or cargo area door. The seals include electronics for sensing the locked state of the bolt and for transmitting the locked and tampered states. The seals employ GPS locating and cellular telephone communications & tracking systems for tracking the seal utilizing RFID seal tampering technology.

OF INTEREST ARE THE FOLLOWING PATENTS AND PUBLICATIONS

U.S. Pat. Nos. 5,005,883, 5,127,687, 4,802,700, 5,347,689, 5,413,393, 6,265,973 ('973), 6,407,666 ('666), 6,097,306 ('306), 7,239,238 ('238) and others are commonly owned and disclose various seals including electronic seals ('973, '666 and '238)(a programmable seal '306) including shackles made of stranded metal wire ('238), steel bolts ('666 and '973) and still other arrangements, all incorporated by reference herein.

Of interest are US Publication 2009/0066503 filed Nov. 29, 2007 in the name of Lien-Feng Lin published Mar. 12, 2009 and claiming priority on TW 096133563 Sep. 7, 2007 and TW 096135554 Sep. 21, 2007 and US Publication 2009/0072554 filed Sep. 11, 2008 in the name of Paul. R. Arguin published Mar. 19, 2009 claiming priority on U.S. provisional application No. 60/993,599 filed Sep. 13, 2007, all incorporated by reference herein in their entirety.

The Lin publication discloses a system for monitoring containers with seals and includes a seal, an electronics monitoring device and a communications center. The monitoring device is connected to the seal which locks the doors. The device detects the seal status and also detects the seal's position using a GPS locating system communicating the data via cell phone technology. The related seal data is sent to a communications center which determines the position of the related container and whether the doors have been tampered with and opened. The seal contains RFID data identifying the seal. A plug is inserted into a socket and detained by a detaining device in the socket. The seal plug is first inserted through a buckle of a door engaged with a buckle of another door, through the seal shell containing the electronics and then into the socket. The monitoring system communicates with a communications center, preferably a mobile phone such as a GPS cell phone through one or more stations and communicates with the communication center through GSM stations.

A detection unit detects the presence of the plug using a micro-switch, a spring-biased switch, or a reed switch. When the plug is torn or cut, the switch detects this and changes the electrical status. In the alternative, a photobreaker may be used to optically detect the presence of the plug. When the plug is removed by cutting or tearing, the optical path is no longer broken to the optical detector and the seal's tampered state is indicated.

When a reed switch is used, a magnet is also required. The seal plug may be designed to be reused and inserted and pulled from the socket many times. Therefore, in this mode the plug is not permanently locked to the socket.

The Arguin publication discloses a pin (bolt) style cargo seal with a removable tracking module. A pin is inserted into a barrel portion, which is removeably secured to a tracking module wherein the structure coupling the tracking module electronically and mechanically to the barrel and pin is not shown or described. The pin is fixed to the barrel and must be cut with bolt cutters or the like to remove the pin from the barrel. The tracking module includes an optional RFID component which deactivates upon tampering or cutting the bolt. The electronics in the tracking module includes an RFID circuit, which may be active, passive or semi-passive. The electronics includes GPS and cellular technology. The cellular technology is typically Global System for Mobil Communications (GSM) or can be Code Division Multiple Access (CDMA) or other technologies including General Packet Radio Service (GPRS). The GSM system uses TDMA for communication between a mobile phone and a base station, wherein several callers may share the same channel. GPRS can be used for Wireless Application Protocol (WAP) access, short Message Service (SMS), Multimedia Messaging Service (MMS) and internet communication services such as email and World Wide Web. The tracking module includes software with scanning of RFID to verify the seal is valid and not tampered with. However, no electronics structure is shown electrically connecting the tracking module to the pin (bolt) for detecting the state of the pin (bolt) or how the tamper state of the bolt is detected.

Containers are widely employed in the cargo industry. The containers have doors which are locked shut with hasps and secured with locking seals, particularly employing bolts. The bolts typically are steel having a head and shank which is locked to a locking device comprising a body having a shank locking mechanism. Such a device and mechanism are shown for example in U.S. Pat. No. 4,802,700. When the shank is inserted into the body, a locking collet or other structural arrangement permanently locks the shank to the body. Further examples of such seals and locking devices are included in the above referenced US patents.

Cargo containers are shipped via land, sea and air transportation. Hundreds of containers may be on a single ship. When the containers are unloaded they may be subject to tampering and vandalism. It is important that such tampering be immediately noted to preclude theft of valuable cargo. To assist in such theft and tampering prevention, prior art seals are assigned serial numbers. These seals are then assigned and locked to the assigned container. The serial number, container number, the carrier, and the location of the cargo are entered into a local computer. The entry then is manually made to show that the container is being shipped out of that location. Should a seal be tampered with, this most likely will occur at a different time and different location.

An electronic tagging device is commercially available that is programmable and which transmits information that is programmed, such as tagging identification serial numbers and other information as desired. This is referred to as radio frequency identification (RFID) which is well known in the art. Generally, an RFID tag will have a radio frequency (RF) transmitter, an RF receiver, an RF modulator, and a memory. The memory retains the digital code manifesting the identification number. The RF modulator extracts the digital code representing the identification number as a modulated signal, which is applied to the RF transmitter. The RF receiver receives interrogation and control signals which manifest a request for the identification number.

Such systems provide security tagging for high value merchandise as it is transferred from the manufacturer to the consumer. Other applications include tagging of animals, humans and vehicles such as trucks and their cargo containers. Other applications include automatic toll collection systems.

FIG. 18 illustrates a prior art RFID communication system 214'. The system includes an interrogator 216' and an RFID tag 218'. The interrogator 216' includes a host controller 220' (a microprocessor) to process received information from the RFID tag 218' via antenna 222' and receiver 224'. To retrieve information from the RFID tag 218', the host controller 220' generates an interrogation command signal which is transmitted by transmitter 226' and antenna 228' as signal 230'. The tag 218' transmits RFID signal 232' via antenna 234' in response to receipt of the interrogation command signal 230'. The receiver 224' receives the signal 232' via antenna 222'. The signal 232' manifests the identification number of the tag 218'.

The RFID tag 218' has an antenna 236' and a receiver 238' to receive the interrogation command signal 230' from the interrogator 216'. The receiver 238' transfers the received command signal to a controller 240'. The controller 240' interprets the command and extracts the corresponding identification number (ID) from memory 242'. The extracted identification number is then transferred by the controller 240' to transmitter 244' which transmits the ID to antenna 234' which broadcasts the signal 232'.

In active RFID tags, power 246' is provided by a battery system. In passive systems, the power is induced from the received signal. The signal 232' transmitted by the RFID tag 218' is modulated back scatter of the original signal transmitted by the interrogator 216'.

The controller 240' may have an interface, not shown, to receive data from external transponders such as temperature sensors, pressure sensors, global positioning sensing and other telemetric measurement data.

Commonly owned U.S. Pat. No. 6,265,973 discloses an electronic security seal which is used with a steel bolt having an insulating coating thereon and a metallic coating on the insulating coating. The metallic coating is in ohmic contact with the bolt head to form a continuous conductor with the bolt shank. A pair of electrical contacts engage the shank and metallic coating to form a circuit path between the contacts. The contacts are coupled to the circuit for sensing a break in the path manifesting a tampered condition wherein the bolt may have been severed opening the path.

U.S. Pat. No. 7,239,238 discloses an electronic security seal using a stranded cable shackle having an internal conductor whose resistance manifests the tampered state of the device and which resistance is monitored by the circuit. This exhibits a similar problem as the '973 patent discussed above. When the shackle is destroyed to open the seal, the entire assembly needs to be discarded. This too is costly.

U.S. Pat. No. 6,407,666 discloses an electrical connector for a cylindrical member such as a steel bolt. Disclosed are a pair of spaced apart rings or similar shaped contacts that make contact with the bolt for completing the circuit between the bolt and sensing circuit. The circuit is for generating a signal manifesting a tampered state of the bolt when the bolt is severed breaking the circuit. The bolt in this device if severed to open the seal results also in the entire assembly being discarded, a costly system.

U.S. Pat. No. 7,042,354 (which includes a family of U.S. Pat. Nos. 6,778,083, 6,791,465, and US publications 2006/0170560 and 2006/0109111) discloses a tamper resistant electronic security seal. The seal comprises a bolt shank, a head which houses the seal circuitry and a bolt locking device which mates with a groove in the bolt shank similar to prior art locking devices. Such a device is shown for example in U.S. Pat. Nos. 4,802,700 and 5,005,883. To open the seal sealed with such a bolt, the bolt needs to be severed and the entire assembly is discarded as the locking device is permanently attached to the bolt via a groove in the bolt. This presents the same problem of cost in using this seal as the seals described above.

U.S. Pat. No. 6,747,558 ('558) to Thorne describes an electronic bolt type security seal using two adjacent magnetic fields as bolt sensors. The fields are generated by two corresponding coils located in corresponding two adjacent arms extending from an electronic seal module housing the rest of the circuitry. The bolt passes through the arms and coils. A locking device is attached to the bolt to secure the bolt to a hasp. When the bolt is severed, the seal module and arms may be reused. However, this design is different than the commercially available modules of the prior art seals discussed above, which seals require that the electronic modules be discarded when the bolts are opened and also discarded. This patent does not solve the problem with those other prior art electronic bolt seals, because it uses a different circuitry than the prior art circuitry commonly used.

The present inventors recognize a need for use of an electronic module that employs prior art circuitry wherein the bolt forms a secondary portion of the circuitry to form a low cost seal and a communication system that is versatile and can communicate continuously as well as track the seal during its travels in the locked state. The use of a low cost seal system represents a problem not addressed by U.S. Pat. No. 6,747,558. The relatively small coil portion of the circuitry (not used in conventional seal tamper evident circuits) is housed in arms separate from the electronics circuitry housing for the majority of the involved circuits etc. That is, the detection circuitry is not entirely within a single housing and makes the system more costly than a single module system.

Further, the bolt is not part of the circuit, but is used only to transmit magnet fields somewhat in a similar manner to a switch. When the bolt is present the magnetic field of one coil is transmitted to a second coil of the detection circuit, which coil normally can not detect the field without the bolt being present. The detection circuit detects the magnetic field in this second coil. The two coils are in separate housings that are attached to an arm. The arm is attached to the main circuit module housing. When the bolt is inserted through the two coils it is also inserted into the hasp for locking the hasp. The two coils form a part of the detection circuit, but are in costly separate housings. This is more costly than a single housing as desired by the present inventors.

The Lin publication does not use a bolt that completes the detection circuit and does not form a part of the detection circuit, but rather includes switches and optical devices, which mechanically open and close the circuit in response to the presence of a bolt. No circuit is employed in the disclosed bolts, which are only used to physically activate a switch when present. When the bolt is absent, the switches have one on/off state manifesting the tampered unlocked state and when the bolt is present, the switches switch to their other state manifesting the normal locked condition.

The U.S. Pat. No. '558 also describes seals with reusable housings and disposable bolts. These seals are not described as being electronic. In this description, an end of the bolt is locked inside the seal housing not otherwise described. To open the seal the bolt is cut with a bolt cutter. The end of the bolt inside the housing can then be removed by sliding the remaining bolt portion out of the housing in the same direction as the insertion direction. This seems to require the housing to be opened to access the bolt fragment to remove it from the housing. No drawing or reference document is cited by the '558 patent showing the particular device being described therein. While this device may solve the problem of providing a reusable housing, it does not seem to be directed to electronic seals.

The cited circuit housing described by '558 appears to be needed to be opened to remove the remnant of the cut bolt from inside the housing. In electronic seals, opening the housing is not desirable as the electronic circuitry inside the housing may become contaminated and unusable. The present inventors recognize a need for a low cost electronic seal module that is both reusable and which need not be opened to reuse the module and thus avoid contaminating the interior circuit. A need is also recognized for a reusable electronic seal module for use with conventional tamper evident circuits and conventional bolt locking devices and indicative security seals which are not as robust as a bolt seal, are lower cost and provided mainly to show tamper evidence. Such tamper evidence further reduces the cost of the system as recognized by the present inventors.

The latter seals are of the strap, padlock and similar arrangements typically made of thermoplastic and are low cost. They are used to indicate tampering with various hasps such as used on electric or gas meters, mini bars as used in hotels and airlines, and a host of other applications where tamper evidence is desired rather than a robust secure locking device as provided by bolt seals in particular.

U.S. Pat. No. 5,152,650 discloses an electrically conductive synthetic resin bolt.

German document DE 010322648 discloses plastic fixing screws for door lock cylinders with embedded conductive strips to operate an alarm if the bolt is deformed by tampering.

Int'l application WO 2006/074518 discloses a transponder bolt seal and a housing for a transponder. An actuator is actuated upon engagement of the sealing mechanism to render the transponder operable. Insertion of a locking member into a receptacle causes the actuator to actuate. The device has a curved shape with a convex side facing away from the sealing mechanism and a concave side facing the sealing mechanism. A cover is used and if the bolt is removed, the cover is damaged, and thus this seal is not reusable if the bolt is removed to open the seal. This application does not address the need for a less costly seal system employing a reusable electronic seal module for use with conventional bolts and locking devices.

The present inventors also recognize a need for a low cost electronic seal that uses GPS and cell phone communication and tracking technology to enhance seal tracking and also to enhance efficient and real time reporting of tampered seals and their locations.

In one embodiment, an electronic security bolt seal with a reusable electronics module for locking a hasp comprises an electronics circuit having first and second portions; an electronic module comprising a housing having a cavity, the first portion of the electronics circuit being entirely in the cavity for monitoring the tamper status of the seal; a bolt having a head and an elongated shank engaged with the housing cavity, the bolt including the second portion of the electronics circuit engaged with the first portion of the electronics circuit for completing the electronics circuit and for engaging the hasp to be locked; a bolt locking device engaged with and locked to the bolt external the module to secure the module to the bolt in the locked state and to lock the bolt to the hasp, the electronics circuit for sensing the integrity of the engaged locked bolt manifesting the seal tamper state, the locked bolt having an exposed region external the module for selective severing of the bolt at the exposed region to interrupt the electronics circuit second portion while unlocking the seal from the hasp and release the module from the bolt for subsequent reuse of the module; and a tracking and communications system employing the electronics circuit first portion attached to the module for communicating the seal monitored status and the seal's position to a communications center.

In a further embodiment, the tracking and communications system comprises a GPS system comprising a GPS receiving unit coupled to the electronics circuit first portion for receiving and processing seal positioning signals from GPS satellites.

In a further embodiment, the tracking and communications system comprises a cellular phone communications unit coupled to the electronics circuit first portion and which unit communicates with a communications center via cellular towers.

In a further embodiment, the tracking and communications system detects and tracks the geographic position of the seal via a cellular phone tracking system coupled to the circuit first portion, the tracking and communications system comprising a cellular phone communications unit which sends seal status data from the circuit first portion and seal tracking data from the tracking system to a communications center via the communication unit and cellular towers.

In a further embodiment, the seal tracking and communications system comprises a GPS tracking system and a cellular phone tracking system coupled to the electronics circuit first portion and a controller for selecting one of the GPS and cellular phone tracking systems to track the position of the seal.

In a further embodiment, the communications system includes a cellular phone communications unit for communicating to a communications center via cellular towers.

In a further embodiment, the seal tracking and communications system comprises a cellular phone tracking system coupled to the electronics circuit first portion, the cellular phone tracking system comprising an electronic arrangement for inputting cellular tower location data identifying the location of each of a plurality of towers adjacent to the seal for computing the location of the seal by triangulation computation of the inputted plurality of tower location data.

In a further embodiment, the tracking and communications system comprises a GPS system comprising a GPS receiving unit coupled to the electronics circuit first portion for receiving seal positioning signals from GPS satellites, the electronics circuit first portion for processing the received GPS positioning signals to track the position of the seal.

In a further embodiment, the seal tracking and communications system comprises a cellular phone tracking system coupled to the electronics circuit first portion, the cellular phone tracking system comprising an electronic arrangement for inputting Wi Fi access points location data identifying the location of each of a plurality of Wi Fi access points adjacent to the seal for computing the location of the seal by triangulation computation of the inputted plurality of access points location data.

In a further embodiment, the seal tracking and communications system comprises a cellular phone tracking system coupled to the electronics circuit first portion, the cellular phone tracking system comprising an electronic arrangement for inputting Wi Fi access points and cellular tower locations data identifying the location of each of a plurality of towers and Wi Fi access points adjacent to the seal for computing the location of the seal by triangulation computation of the inputted plurality of tower locations and Wi Fi access points data.

In a further embodiment, the bolt includes first and second electrically conductive members in electrical isolation from each other forming the second circuit portion and ohmically engaging the electronics circuit first portion to form a circuit path to the electronics circuit first portion.

In a further embodiment, the bolt passes completely through the module, the bolt and module including a contamination sealing arrangement for cooperatively sealing the module cavity from ambient region contamination external the cavity.

In a further embodiment, the bolt is dimensioned to pass through the housing and includes a tip portion protruding from the housing, the tip portion and the locking device being arranged to lock the locking device to the tip portion, further including a contamination sealing arrangement for sealing the module cavity from contamination from the external ambient region in cooperation with the bolt.

In a further embodiment, the bolt is dimensioned to pass through the housing in a compartment in the cavity from an ingress first aperture and egress the housing at a second aperture, the bolt including a tip portion protruding from the housing through the second aperture, the tip portion and the locking device being arranged to lock the locking device to the tip portion, further including a contamination sealing arrangement comprising a grommet on the housing at the second aperture and a sealing element attached to the bolt for sealing the first aperture when the bolt is in a position for being locked, the grommet and sealing element for sealing the module compartment from ambient external contamination.

In a further embodiment, the bolt has a tip region, and includes a first sealing element intermediate the bolt head and the tip region, the housing has a second sealing element for engaging the bolt at the tip region.

In a further embodiment, the bolt has a tip region, and includes a first tapered sealing element surrounding the bolt at a location intermediate the bolt head and the tip region, the housing having a second sealing element for engaging the bolt at the tip region, the module being secured in a region that is generally between the first and second sealing elements.

IN THE DRAWING

FIG. 1 is a front elevation view, partially in section, of an electronic security seal attached to a hasp according to an embodiment of the present invention;

FIG. 1*a* is an isometric view of the locking device of FIG. 1;

Figure 1:
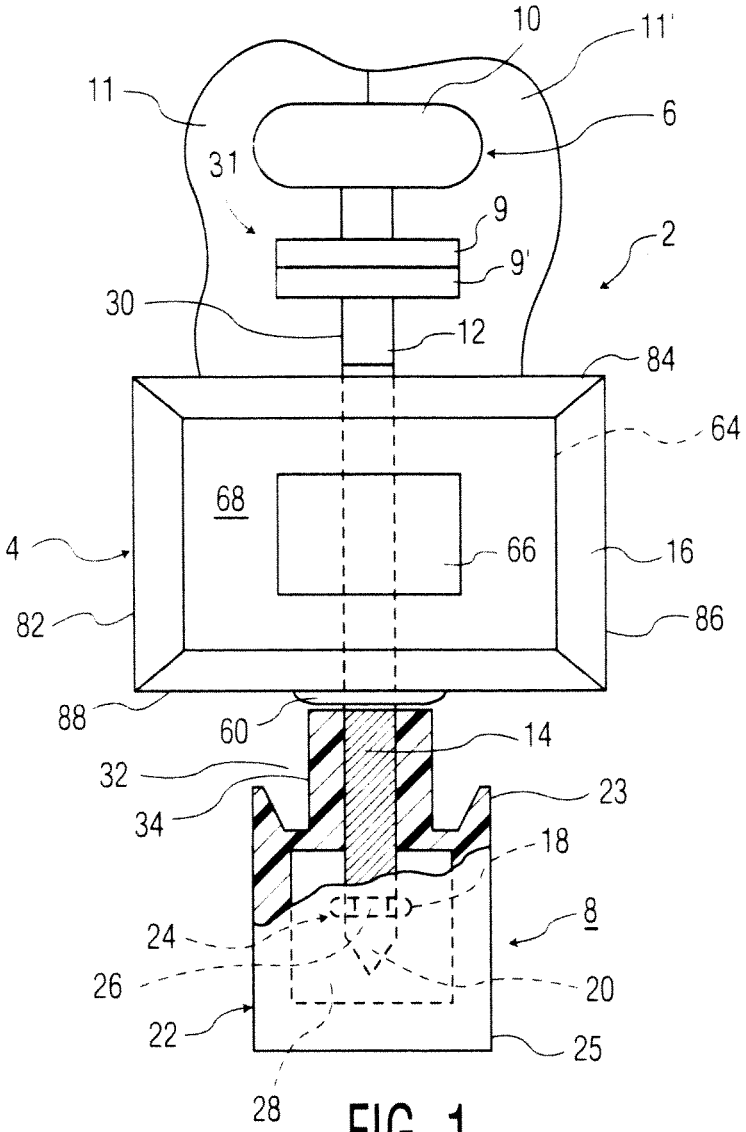
Figure 2:
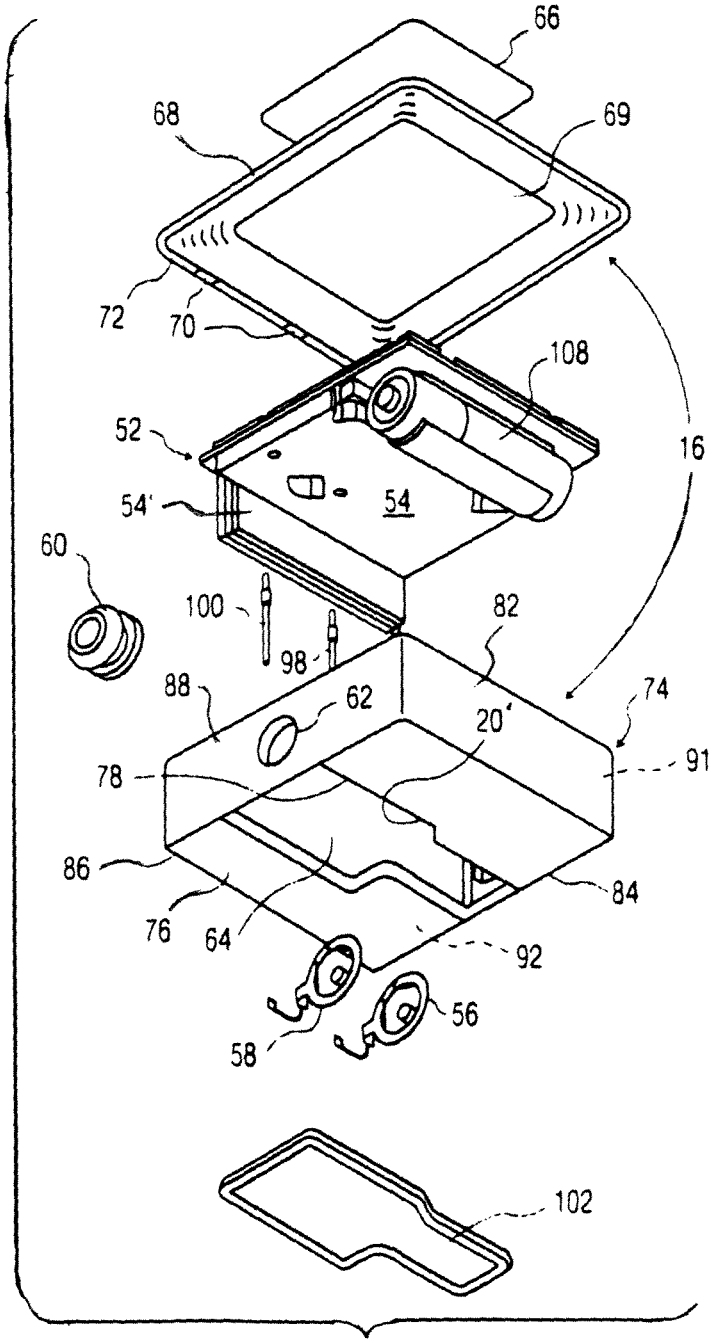
FIGS. 2 and 3 are respective exploded isometric views of a portion of the electronic seal module of FIG. 1, FIG. 2 showing the view from the bottom of the seal module and FIG. 3 showing the view from the top of the seal module.
Figure 3:
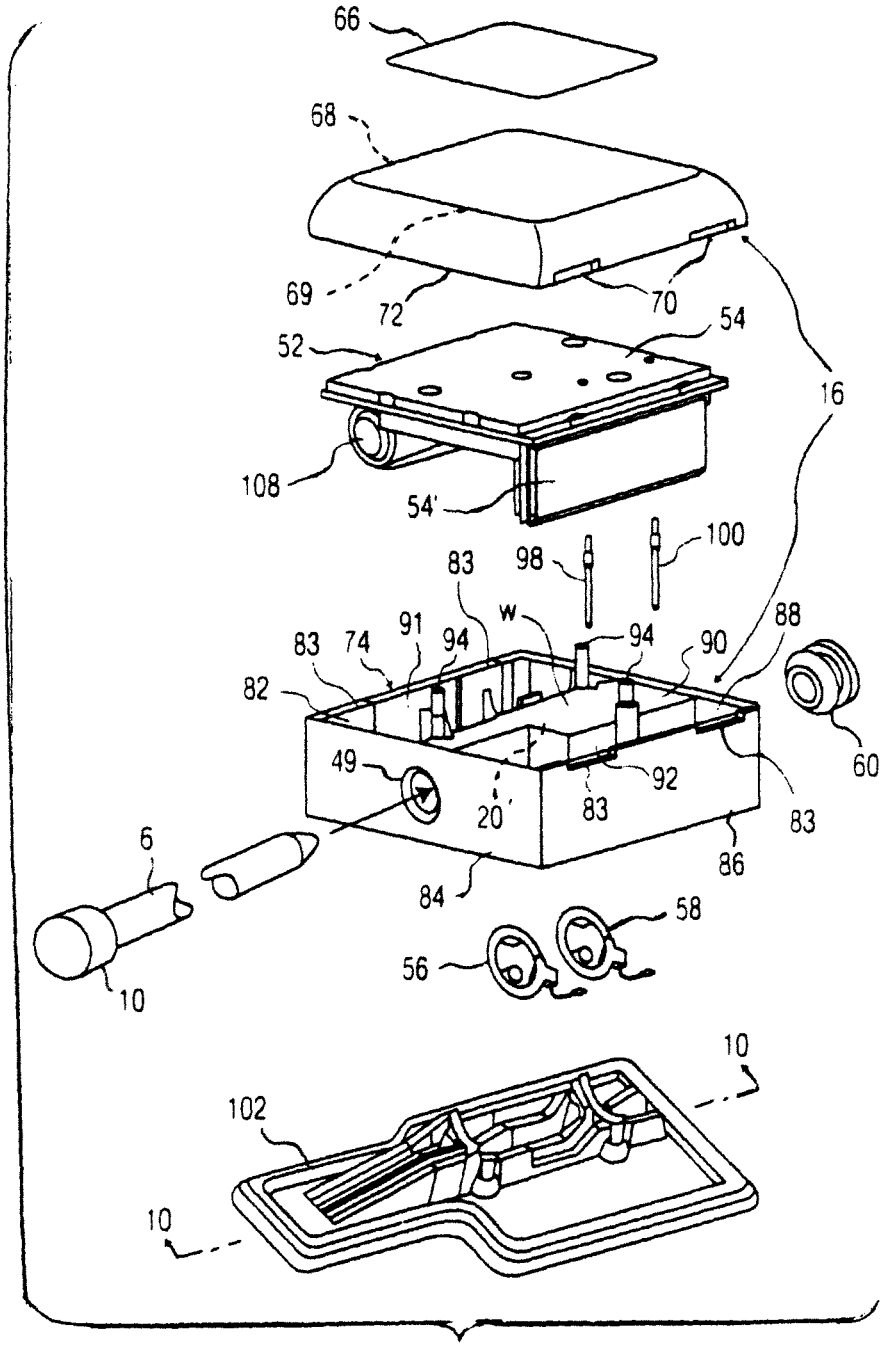
Figure 5:
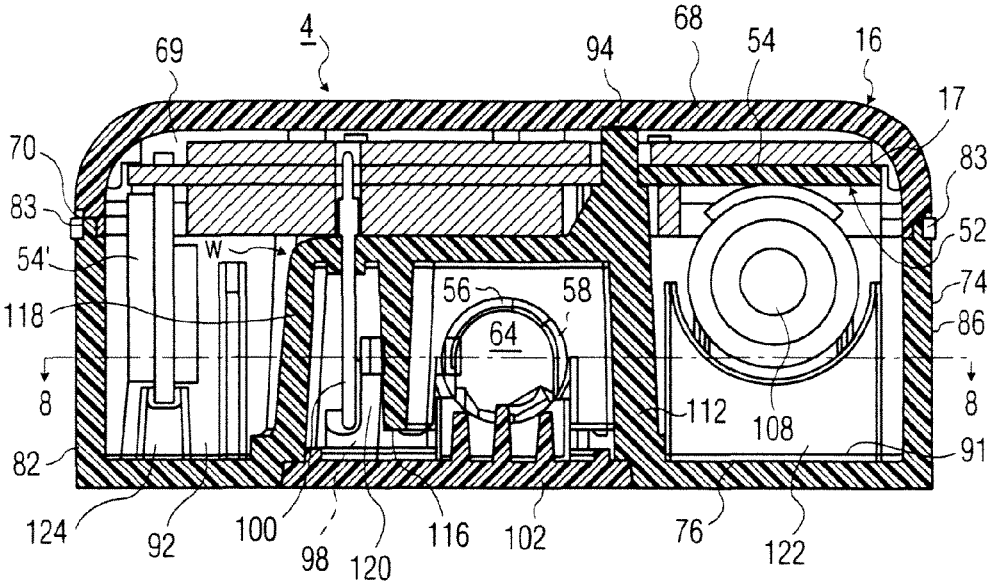
FIG. 5 is an elevation sectional view of the electronic module of FIG. 7 taken along lines 5-5.
Figure 5A:
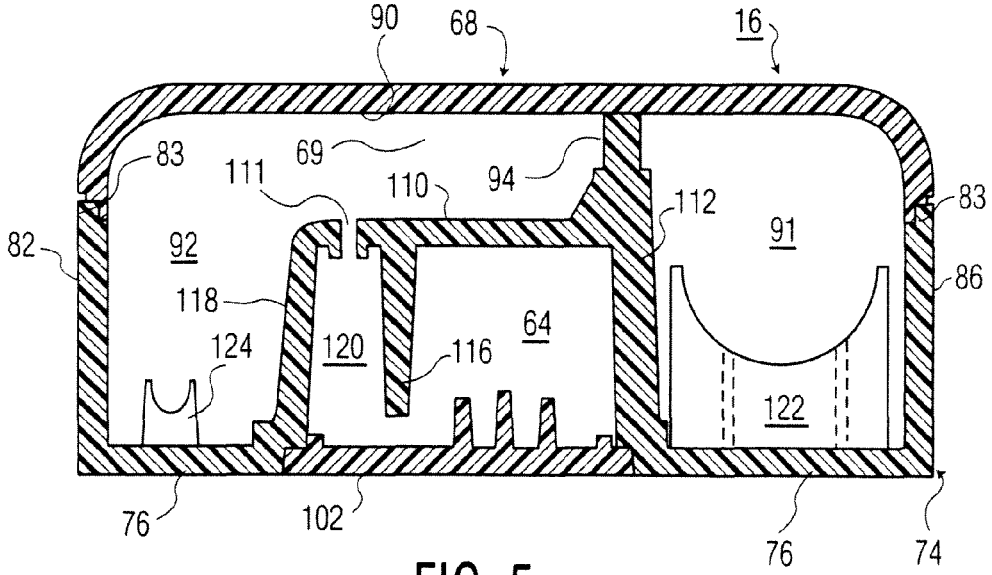
Figure 6:
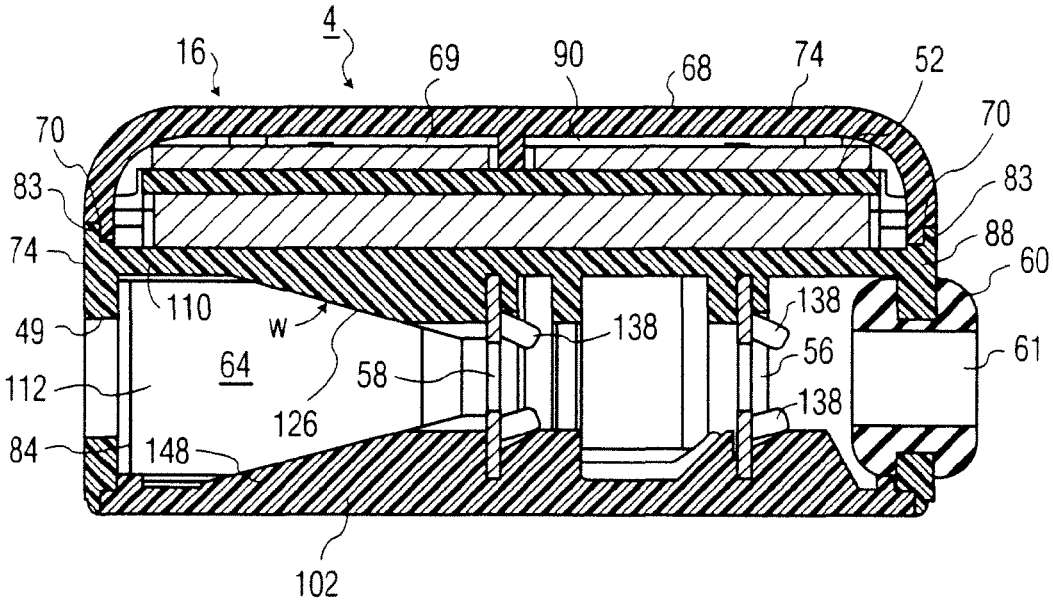
Figure 7:
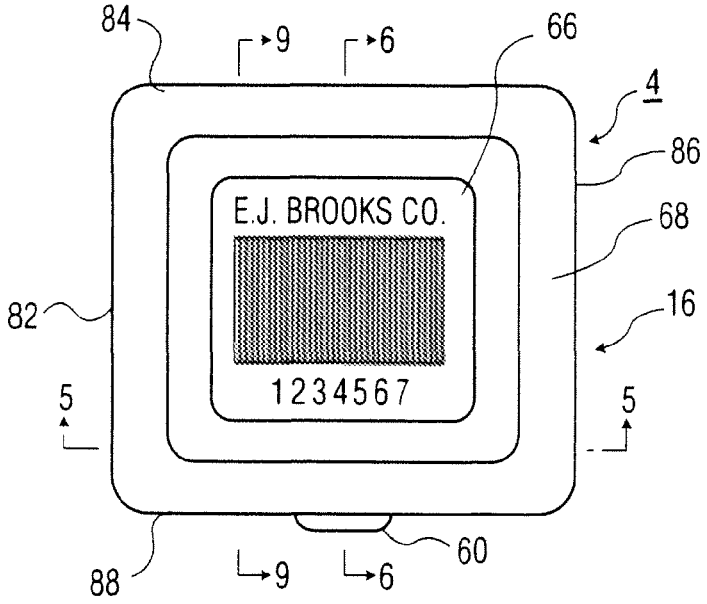
Figure 8:
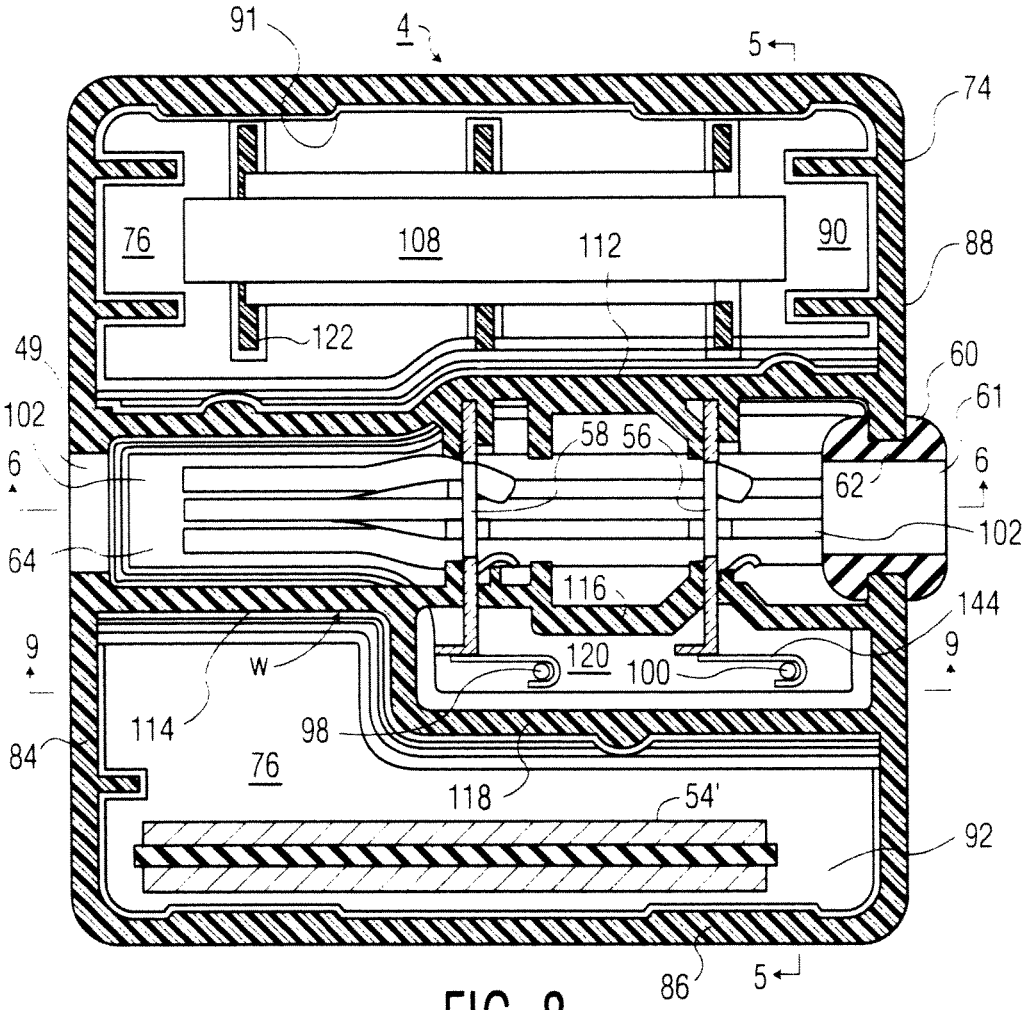
Figure 9:
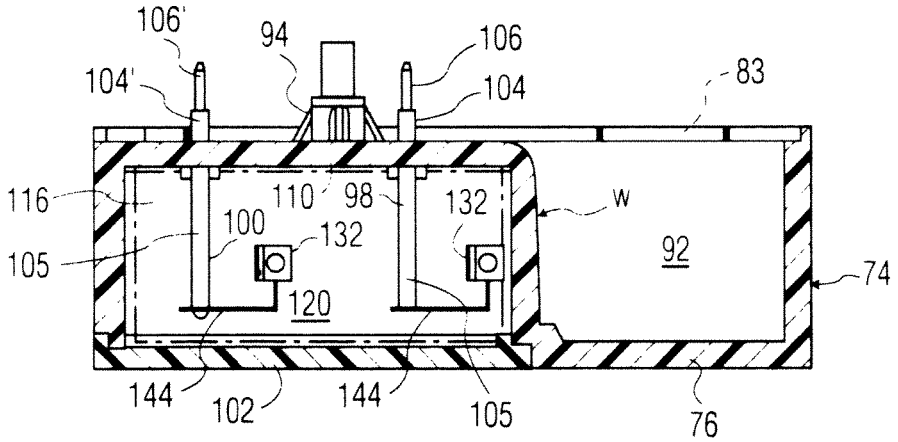
Figure 10:
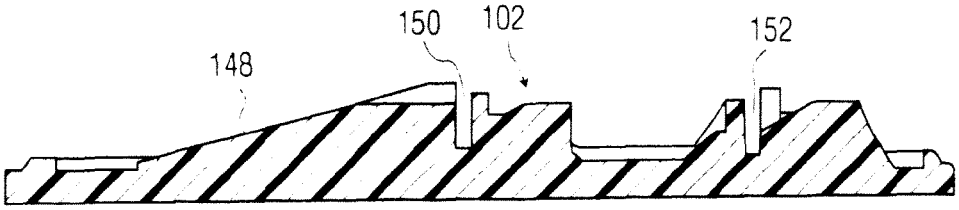
Figure 11A:
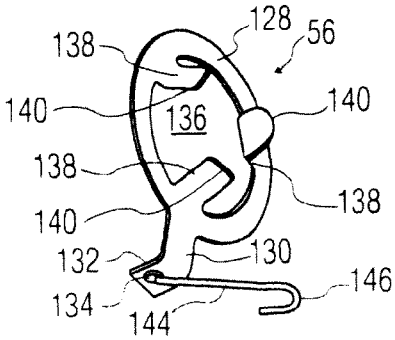
Figure 11B:
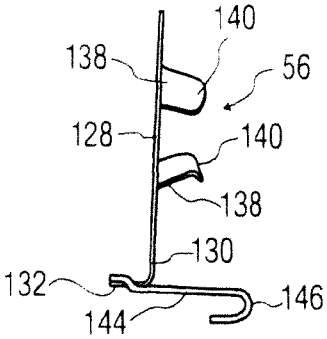
Figure 11C:
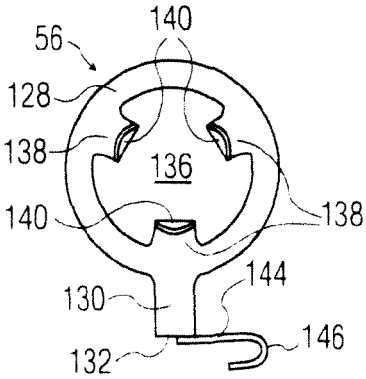
Figure 12:
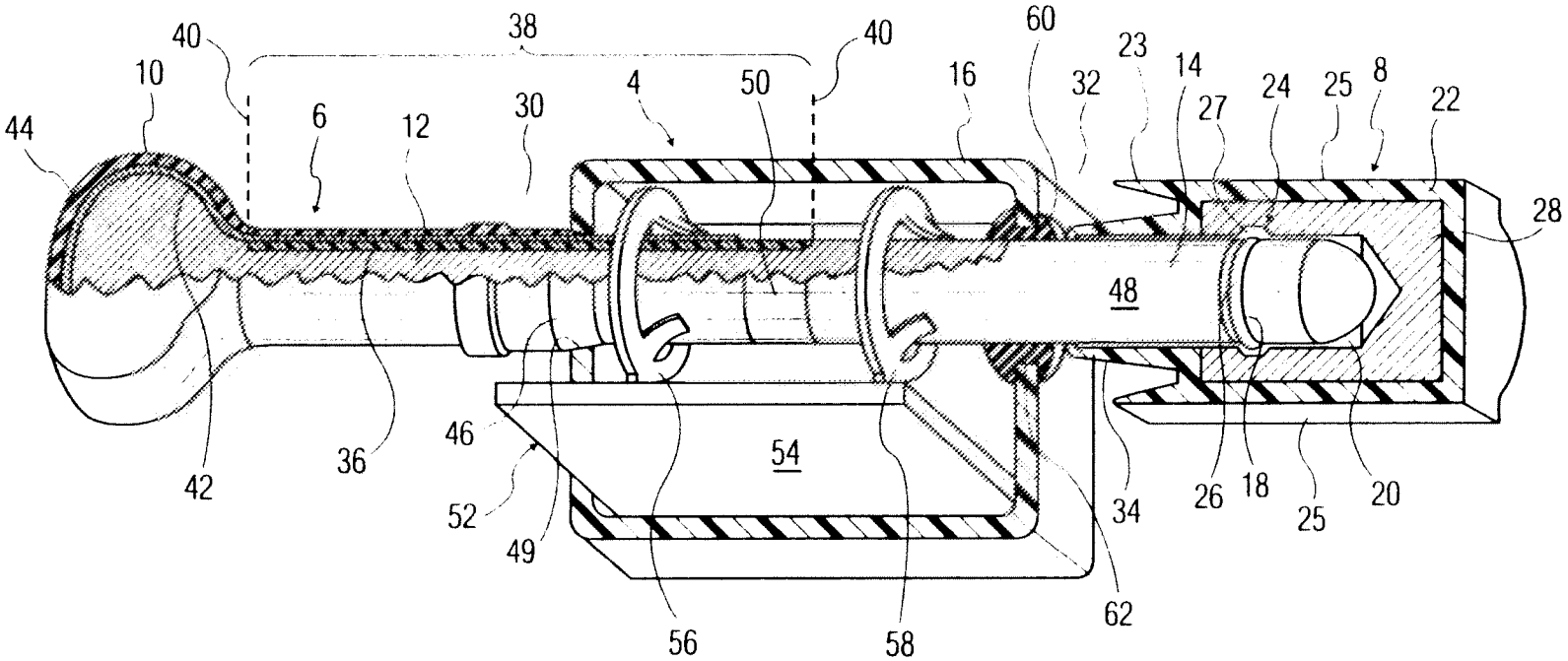
Figure 13:
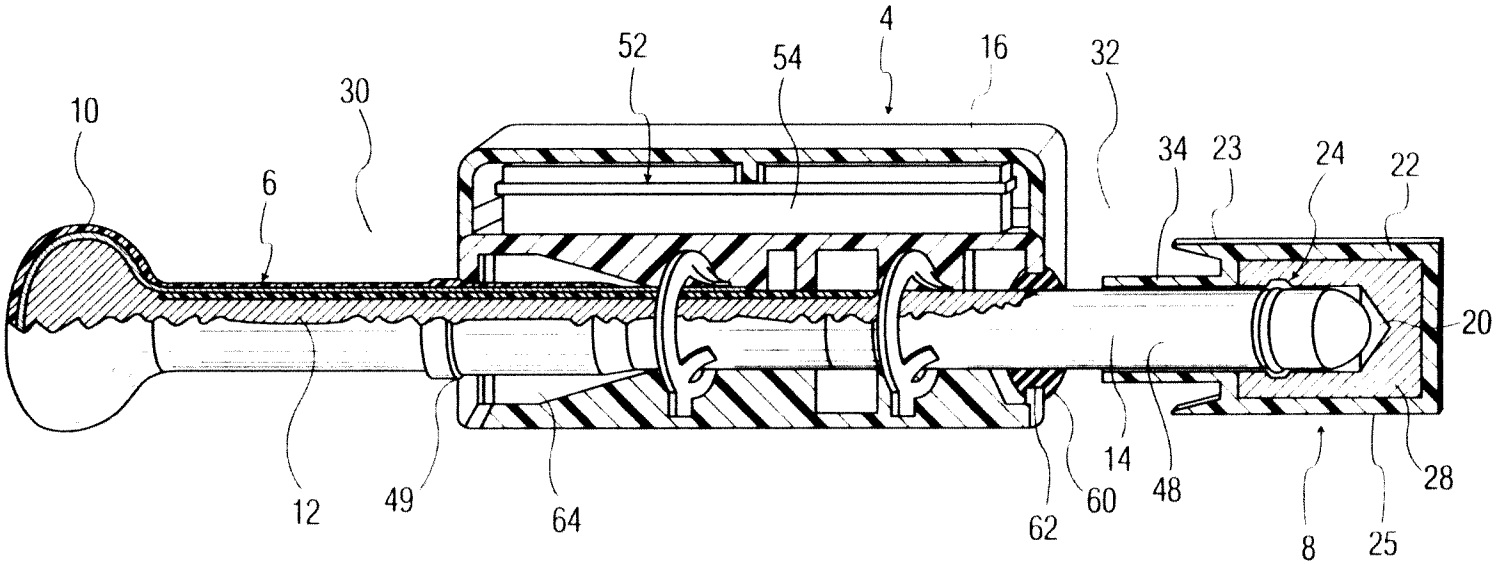
Figure 14:
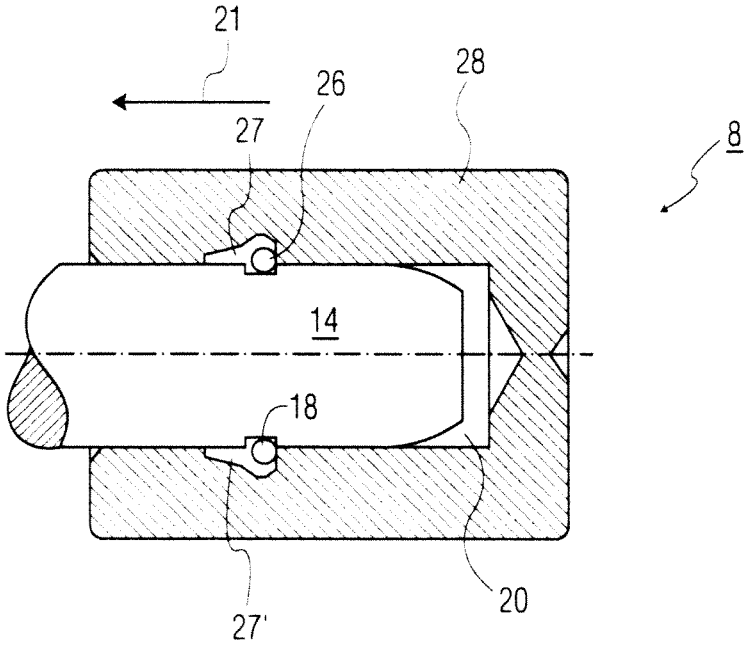
Figure 15:
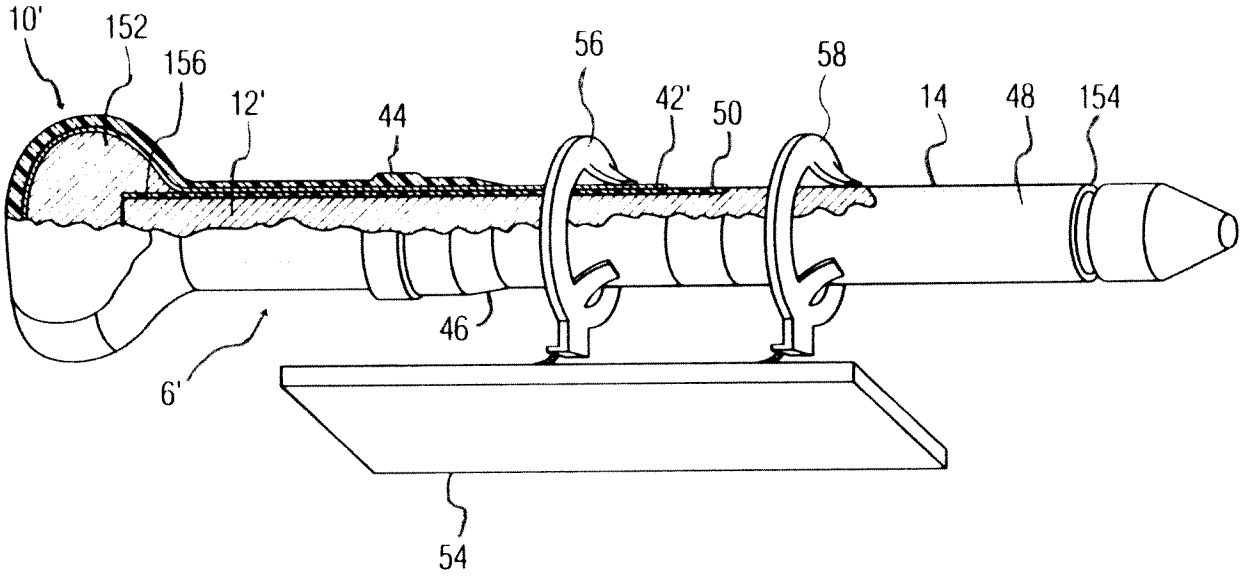
Figure 16:
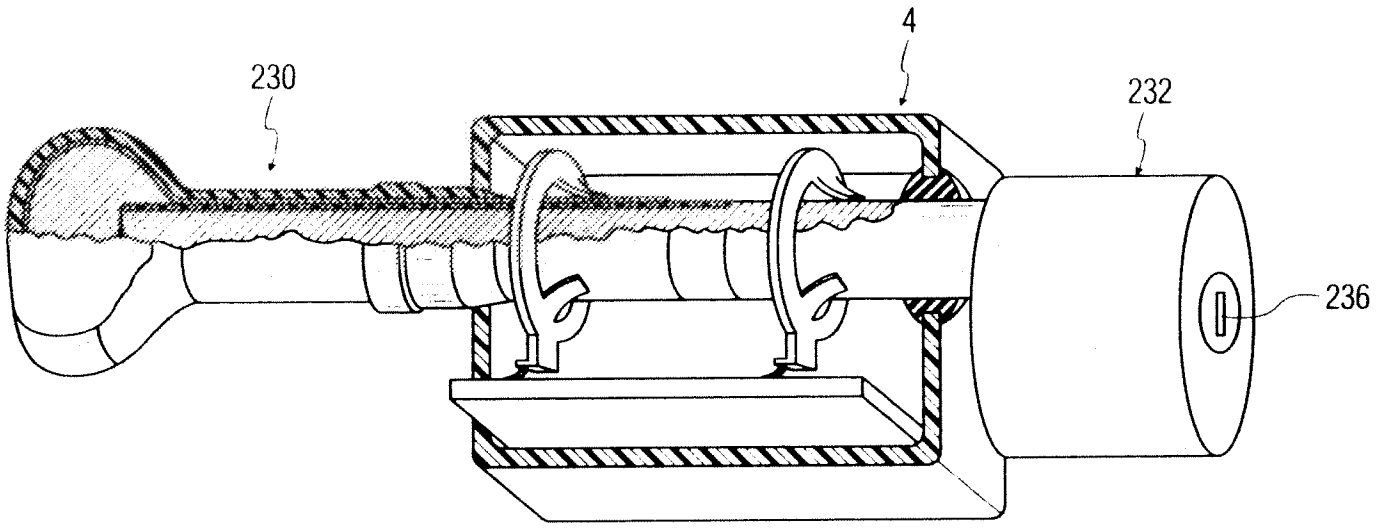
Figure 17:
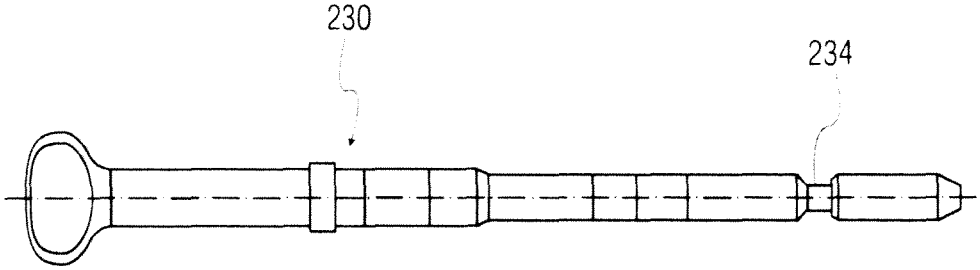
Figure 18:
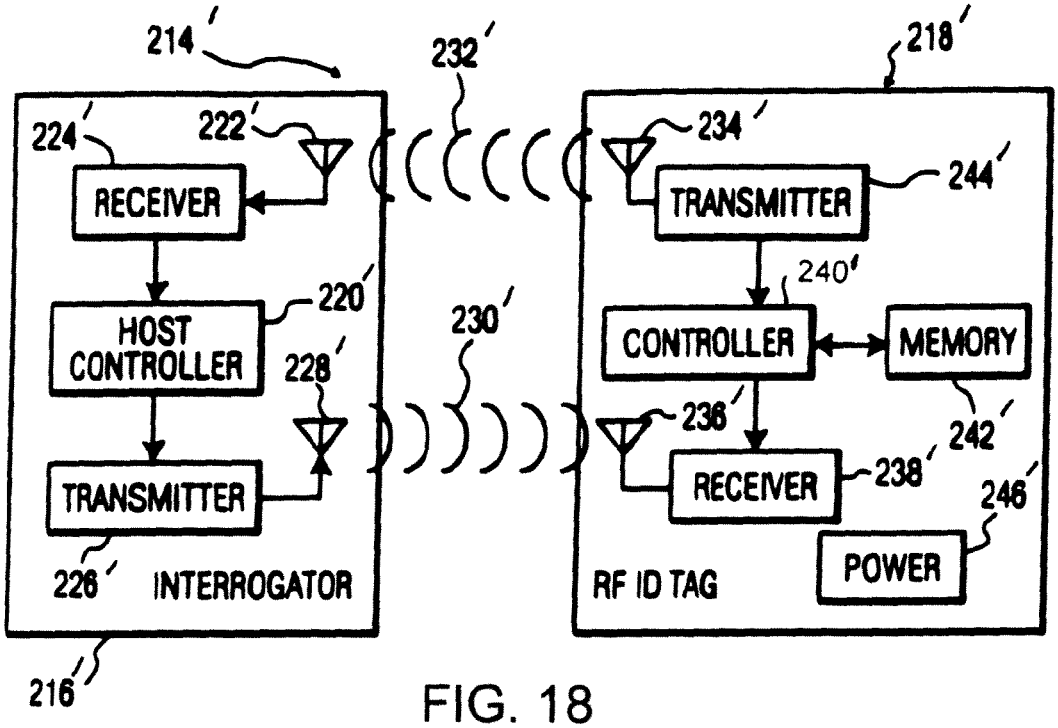
FIG. 18 PRIOR ART
Figure 19:
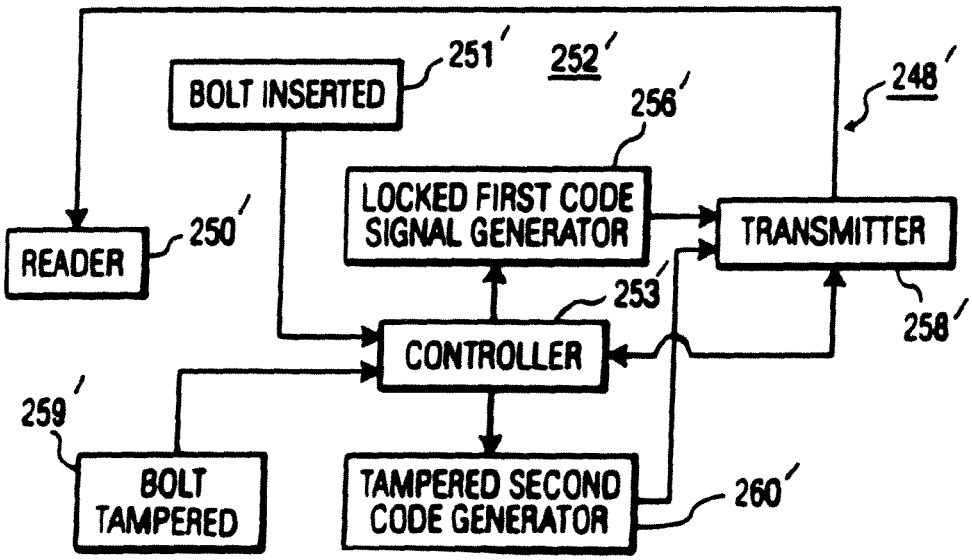
FIG. 19 PRIOR ART
Figure 20:
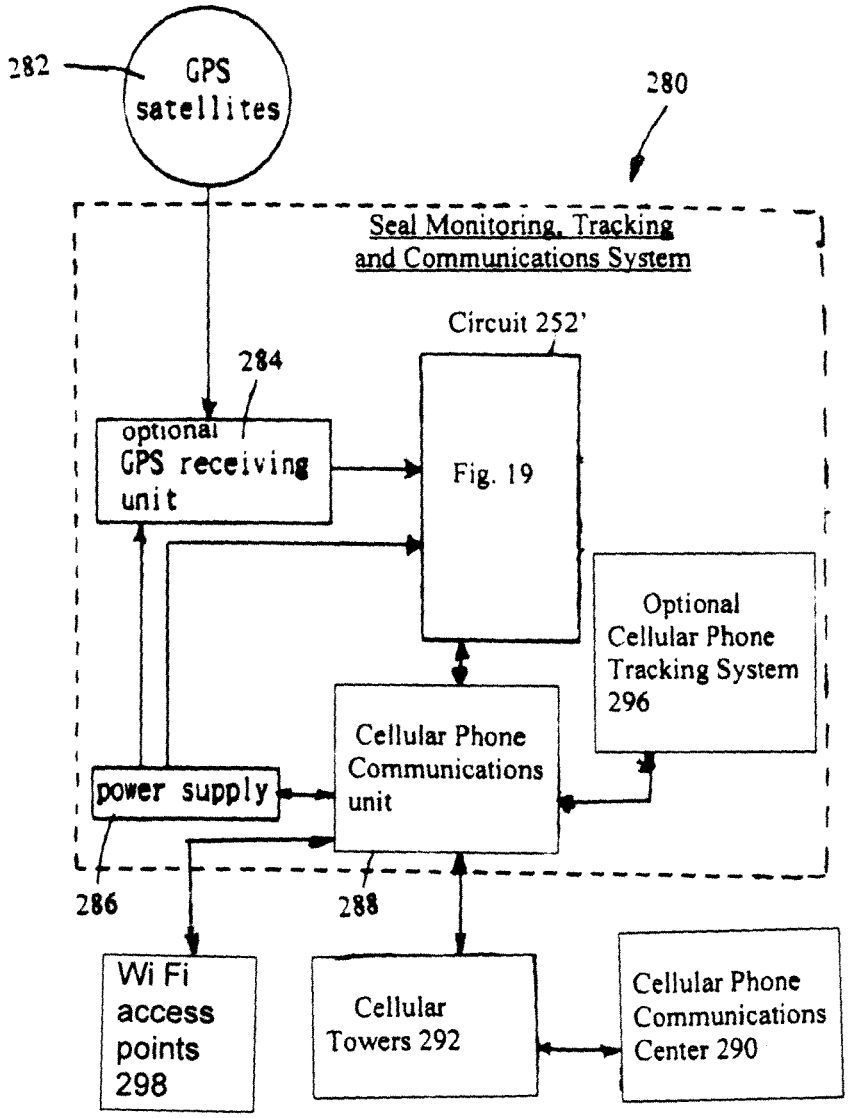

FIG. 5*a* is an elevation sectional view of the module housing similar to FIG. 5 but without the interior components of FIG. 5;

FIG. 6 is an elevation sectional view of the electronic module of FIG. 7 taken along lines 6-6;

FIG. 7 is top plan view of the electronic module of FIG. 1;

FIG. 8 is a plan sectional view of the electronic module of FIG. 7 taken along lines 8-8 of FIG. 5, in FIG. 8, the lines 5-5, 6-6 and 9-9 are given for illustration to show where in the structure the views at lines 5-5, 6-6, and 9-9 in FIG. 7 are taken;

FIG. 9 is an elevation sectional view of the electronic module of FIG. 7 taken along lines 9-9;

FIG. 10 is an elevation sectional view of the bottom cover of the electronic module of FIG. 3 taken along lines 10-10;

FIGS. 11*a*, 11*b* and 11*c* are respective isometric, side elevation and front elevation views of the electrical contacts employed in the embodiment of FIGS. 2 and 3;

FIG. 12 is an isometric partially in section view of a schematic representation of a bolt, an attached bolt locking device and electronic module according to an embodiment of the present invention;

FIG. 13 is an elevation partially in section view of the bolt assembly of FIG. 12 showing the module housing, bolt locking device and bolt electronic module and showing the electrical conductors in the bolt;

FIG. 14 is a sectional side elevation view of a bolt locking device employed in the disclosed embodiments;

FIG. 15 is a side elevation partially in section of a schematic representation of a bolt according to the embodiments of FIGS. 12 and 13 without the locking device attached;

FIG. 16 is a side perspective view of a further embodiment of a bolt, seal and contact arrangement of an electronic seal with a key padlock attached to the bolt according to the embodiment of FIG. 17;

FIG. 17 is a side elevation view of a bolt for the embodiment of FIG. 16;

FIG. 18 is a schematic diagram of a prior art circuit of an RFID and interrogator circuit;

FIG. 19 is a block circuit diagram of a prior art circuit which may be used with the electronic module of the seal according to an embodiment of the present invention; and FIG. 20 is a block circuit diagram of a monitoring circuit used in the seal of FIG. 1 illustrating an embodiment employing optional GPS and optional cell phone technologies for tracking the seal and communicating the seal tracked position and tamper status.

Figure 1A:
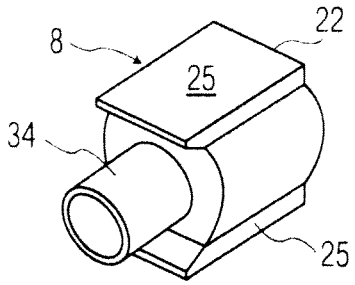

In FIG. 1, electronic bolt type security seal 2 according to one embodiment of the present invention includes an electronic seal module 4, a bolt 6 and a locking device 8 (FIG. 1*a* and FIG. 14, without outer shell 22 of FIG. 1). The bolt is locked to a hasp 31 comprising staples 9, 9', and to the module 4 by the locking device 8. The module 4 comprises a housing 16 having a cavity and internal components in the cavity to be described below. The bolt seal 2 locks the hasp staples 9, 9' and releasably secures the module 4 to the staples as well. The staples 9, 9' may be part of a cargo container door 11 and door jamb 11', for example, for locking the container door 11 shut.

In FIGS. 1, 12 and 13, the bolt 6 has a head 10 and a shank 12, which is circular cylindrical, but may be other shapes. The shank 12 has a tip portion 14 which protrudes through the housing of the module 4. The bolt has a tip portion 14 that protrudes from the module 4 and is locked to the locking device 8 via an annular groove 18 in the outer circumferential surface of the bolt tip portion 14.

In FIG. 14, the locking device 8 (without the shell 22) is shown in more detail. The locking device has a steel body 28 with a cavity 20. Inside the cavity 20, there is a locking mechanism 24 which comprises a partial spring steel ring 26. The ring 26 is received in internal annular stepped groove 27 in the locking body 28 cavity 20, a longitudinal bore. The groove 27 has an enlarged tapered section and a smaller diameter cylindrical portion in the cavity 20. The ring 26 in the groove 27 expands in the tapered section as the bolt tip portion 14 is inserted. The ring 26 then becomes aligned with the groove 18 when the bolt shank portion 14 is inserted into the cavity 20. The ring expands in response to the shank insertion into the cavity 20 and then returns to its quiescent diameter by its compressing partially into the shank groove 18.

When the bolt 6 is attempted to be unlocked by retracting it out of the cavity 20, direction 21 opposite the insertion direction, the ring 26 is compressed further into the groove 18 of the bolt by a smaller diameter step 27' in the body groove 27. The step 27' in the body groove 27 and the bolt groove 18 cooperate to lock the ring and bolt to the body 22 to preclude further withdrawal of the bolt from the body bore 20. The locking mechanism 24 permanently locks the bolt 6 tip portion 14 to the body 28 requiring the bolt to be severed to open it.

The locking device 8, FIGS. 1, 1*a*, 12 and 13, has an outer thermoplastic molded shell 22 encasing the inner steel body 28.

The only way to open the seal 2 is to cut the bolt 6 with a bolt cutter or similar device. For this purpose, the shank 12, FIG. 1, is shown for illustration with an exposed region 30 between the module 4 and the hasp 31 and an exposed region 32 between the locking device 8 and the module 4. In practice, the only exposed regions for receiving a bolt cutter is region 32. While the region 30 and a further exposed region of the bolt is shown in FIG. 1 between the hasp 31 and head 10, this is only for illustration.

The thermoplastic shell 22 of the locking device 8 has a thermoplastic collar 34 one piece with and extending from the shell. The bolt shank 12 region 32 is substantially covered by the collar. In practice, the shank region 30 between the module 4 and the hasp 31 and the shank region between the hasp 31 and the head 10 is non-existent with a close clearance with the bolt at these regions. Thus a bolt cutter will not have access to the shank 14 in these other regions. In this case, the only access to cut the shank is in the region 32. The locking device collar 34 being plastic is easily severed.

The collar 34 secures the module 4 tightly against the bolt and also in a further embodiment against the hasp 9, 9' (not shown). This action seals the module 4 interior from the external ambient atmosphere as will be explained. Also this action keeps the module from moving along the bolt shank or vibrating in use in the locked state. This action tends to minimize wear of the contacts to be described below. The shell 22 FIGS. 1, 12 and 13 has an overhang portion 23 which overlies a portion of the collar 34. The shell 22 has opposing planar side walls 25 including the overhang portion 23 for receiving indicia such as a unique bar code and/or the manufacturer name and so on.

Once the bolt is cut at the exposed region 32 (or some other region) it can readily be removed from the module 4 and the hasps 9, 9'. This is because there is no locking device internal the module 4 as in some of the prior art electronic security seals. Thus the module 4 is reusable with a new bolt. This reuse is made possible without undesirable opening of the module housing 16 as occurs in some prior art electronic seal systems discussed in the introductory portion.

The bolts 6 are relatively low cost and disposable. The module 4 being relatively costly because it houses the electronics, is saved for reuse and is readily reused after each use. This arrangement provides for users who have high volumes of needs for this type of seal.

To reuse the module 4, a new bolt is inserted through the housing 16 and locked with another relatively low cost locking device, which is also disposable. The electronics, according to a particular implementation employed as known in the prior art, may need to be reprogrammed for each new use in a known way as shown for example below and in certain of the patents noted in the introductory portion. The reprogramming may employ an interrogation unit or other programming arrangement as disclosed in some of the cited patents in the introductory portion. Such programming includes entering the seal unique identification, date and time stamps, location, cargo data, and any other desired data. For example, see several of the patents cited in the introductory portion, which disclose such electronics in more detail such as the '238, 973, 558 and 354 patents among others, and incorporated by reference herein.

In FIGS. 12 and 13, the bolt 6, in one embodiment, comprises a steel bolt shank 12 and steel head 10, which are electrically conductive. An electrically insulating coating 36, which may be plastic, a composite material, or other insulating material, is applied in a conventional manner such as by molding, dipping, vapor deposition, and so on. The coating 36 is applied over an annular shank portion 38 (bounded by dashed lines 40) of the shank 12 adjacent to the bolt head 10. The head 10 and shank 12 may also be one piece or multiple piece metal structures and together form an electrically conductive single conductor. The head for example may be press fit onto the shank in a known manner.

In FIGS. 12 and 13, the bolt 6, in one embodiment, comprises a steel bolt shank 12 and steel head 10, which are electrically conductive. An electrically insulating coating 36, which may be plastic, a composite material, or other insulating material, is applied in a conventional manner such as by molding, dipping, vapor deposition, and so on. The coating 36 is applied over an annular shank portion 38 (bounded by dashed lines 40) of the shank 12 adjacent to the bolt head 10. The head 10 and shank 12 may also be one piece or multiple piece metal structures and together form an electrically conductive single conductor. The head for example may be press fit onto the shank in a known manner.

The bolt outer rubber or plastic layer 44 has a tapered conical region 46 which narrows in diameter in a direction toward the tip portion 14. The module 4 housing 16, FIGS. 12 and 13, has a cylindrical circular aperture 49 for receiving the tapered outer surface region 46 of the bolt shank 12 therein. The bolt region 46 is larger in diameter than the diameter of the aperture in the housing 16 into which the bolt is inserted. This smaller diameter of the aperture 49 as compared to the larger diameter of the region 46 in a direction toward the head 10 prevents the bolt shank 12 from passing further into the aperture beyond the region 46 between the region 46 and the head 10. Thus, only a predetermined tip portion 14 of the shank 12 can enter into and protrude beyond the module 4 cavity. This predetermined tip portion 14 of the shank 12 length protruding beyond the module 4 is determined by the position of the region 46 on the shank relative to the tip portion 14.

This region 46 with its varying diameter along the bolt length relative to the aperture 49 diameter positions the shank 12 tip portion 14 with its metal outer surface and the shank electrical coating 42 in a desired predetermined aligned position in the module interior. This positioning of the bolt coating 42 aligns electrical contacts 56, 58, FIGS. 12 and 13 (to be described below) of the module 4, with the respective coating 42 and metal tip portion 14. This alignment ensures the contacts 56, 58 make the required ohmic electrical engagement with the spaced electrically isolated and electrically conductive contact portions of the bolt. These portions form an electrical path along the shank 12 axial length as seen from FIGS. 12-16 and 18, wherein part of the path is provided by the electrically conductive bolt shank and the electrically conductive layer 42 juxtaposed with a portion of the shank 12.

These conductive shank conductive portions include the shank 12 which has an outer exposed metal surface electrically conductive portion 48 at the tip portion 14 and the electrically conductive layer 42 aligned with the contacts 56, 58. The insulating coating 36 has an annular region 50 at the shank outer peripheral surface. This region 50 electrically isolates the tip 14 conductive portion 48 of the shank 12 outer surface from the electrically conductive layer 42 along an axial extent of the shank 12.

Thus, when the tapered region 46 is axially displaced toward the module 4 and tightly fitted into the aperture 49 of the module housing 16, the ring contacts 56, 58 of the module 4 become aligned with the respective electrically conductive portions of the bolt 6. Also, the tapered region being formed of rubber or plastic forms a contamination seal for sealing the aperture 49 from the external ambient atmosphere. This is important to ensure the electronics does not prematurely corrode or otherwise fail due to ambient contamination. This sealing action of aperture 49 prevents moisture and other contaminants from entering into the module 4 interior of its housing 16 protecting the internal electronic components. The prior art seals do not recognize this problem or offer a solution.

In FIGS. 12 and 13, the module 4 includes a printed circuit board assembly 52 comprising a circuit board 54 mounted inside of the module housing 16. The circuit board 54 has the necessary electronic and mechanical components (not shown) of the seal tamper sensing and RFID operating circuit mounted thereto. The electrically conductive conductors and contacts (not shown) of the board 54 are formed on the board 54 in a known manner.

The circuit includes a pair of spaced apart ring contacts 56 and 58 mounted spaced from the board 54, but electrically connected thereto as will be shown below. These contacts 56, 58 are electrically conductively connected to the specified contact pads (not shown) of the board 54. FIG. 12 is more schematic than FIG. 13, which is more representative of the construction of the module 4 than FIG. 12, which is for illustration. The contacts 56, 58 are in the interior 64 of the module, FIGS. 12 and 13.

In FIGS. 12, 13, a rubber or other material sealing grommet 60 is secured in an opening 62 in a wall of the module housing 16 opposite to and aligned with the aperture 49. The opening 62 provides egress for the shank tip portion 14 into the housing 16 interior compartment 31. The grommet 60 is closely dimensioned relative to the outer diameter of the shank 12 tip portion 14 to resiliently compress somewhat and seal the shank tip portion 14 inserted into the grommet bore 61 (FIG. 6) into compartment 64 of the housing 16. This sealing action occurs when the grommet receives the shank 12 for sealing the module 4 interior. The grommet seals the compartment 64 of the module 4 from external moisture and contamination to protect the circuit within the housing 16 compartment 64 at the tip portion 14.

The grommet 60 permits the bolt shank 12 tip portion 14 to slide through the grommet opening 61 and protrude beyond the housing 16 as shown (FIGS. 1 and 12). The protrusion of the shank tip portion 14 permits the locking device 8 to be attached thereto and thus lock the module 4 to the bolt 10 (and the module 4 and bolt 10 to the hasp 9, 9' (FIG. 1). The plastic collar 34 on the locking device 8 shell 22 (FIG. 1) has an important function. It locks and seals the housing 16 aperture 49 against the tapered plastic or rubber molded region 46 of the bolt 6 in the locked mode (FIGS. 12 and 13). This ensures that the locked module 4 housing 16 is fully seated against the region 46 while the bolt shank tip portion is sealed by the grommet 60. Thus the module 4 compartment 64 is sealed against the ambient contaminants such as moisture and the like at the same time precluding circuit damage therefrom.

A printed circuit board assembly 52, schematically shown in FIGS. 12 and 13, comprises a circuit board 54, FIG. 13. The board 54 includes a programmable circuit (not shown) comprising a CPU, a computer processing unit, memory and other circuit components such as crystals, capacitors and resistors for providing a programmable transmitting RFID tag circuit similar to the circuit 214' of FIG. 18, or as shown in certain of certain of the patents noted in the introductory portion incorporated by reference herein. The board 54 has ring contacts 56, 58 electrically conductively coupled thereto and to the contact pads (not shown) printed on the printed circuit board 54 via pins 98, 100 to be described. The ring contacts 56, 58 are mechanically spaced from the board 54.

The circuit (not shown in this figure) on board 54 may be programmed for receiving a seal identification code, i.e., a unique number assigned a particular seal, geographic location where the seal is being deployed, container identification, e.g., a unique number assigned to a cargo container, the shipping carrier for the container, the container port of origin, container destination, inventory of the container and other data. Such a programming circuit is within the skill of one of ordinary skill in the computer programming art.

Figure 4:
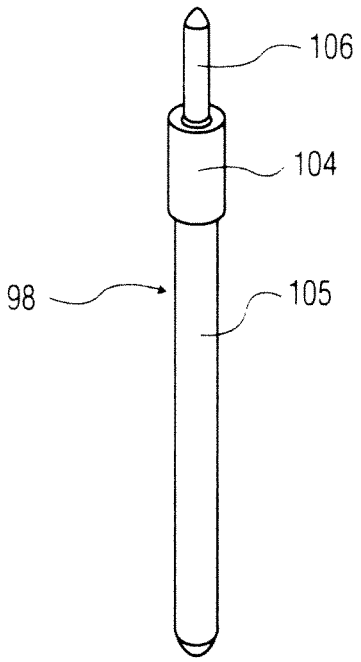
FIG. 4 is an isometric view of a representative electrically conductive pin that is staked to the housing of the module of FIGS. 2 and 3 for electrically connecting electrical contacts engaging a bolt with the printed circuit bolt sensing and transponder circuitry.

Resilient ring contacts 56, 58, FIGS. 12 and 13 e.g., may be made of beryllium copper, are coupled to the board 54 and ohmically coupled to the circuit 248' of FIG. 19 on the board 54 by pins 98, 100 (FIG. 4 shows representative pin 98) for providing electrical battery power to the circuit by closing an ohmic connection between the circuit and battery 108, FIGS. 2, 3, 5 and 8, when the bolt 10 is inserted into the module as shown in FIGS. 12 and 13. The contacts 56, 58, provide a serial connection to opposite polarity terminals of the battery as well as to the circuit to power the circuit.

The module 4 is shown in exploded view from the bottom toward the top in FIG. 2 and from the top toward the bottom in FIG. 3. FIG. 2 shows the bolt egress wall 88 to the left (and FIGS. 6 and 8) with aperture 62 to which the grommet 60 is attached. The bolt (not shown) exits from the grommet 60 as shown in FIGS. 12 and 13. FIGS. 3, 6 and 8 show the bolt ingress wall 84 to the left with the opening 49 into which the bolt 6 is initially inserted. The module 4, FIGS. 2 and 3, comprises, from the top of the drawing down, the following. A label 66 which receives the appropriate indicia identifying the seal and related information. The label 66 is bonded to the top surface of thermoplastic molded top cover 68 of the module housing 16 and has an internal concave chamber 69. The cover 68 has snap fit elements 70 molded into and along the bottom edge of its lower rim 72, FIGS. 2 and 3.

The module 4 housing 16 includes a molded thermoplastic bottom housing member 74, FIGS. 5-8, which is complementary to cover 68. The housing member 74 has outer planar orthogonal side walls 82, 84, 86 and 88. Recesses 83 on the top edge of walls 82, 84, 86 and 88 mate with corresponding recesses on the edge of the rim 72 of the cover 68. Snap fit elements 70 (FIG. 3) on the upper edges of the bottom member 74 mate with complementary elements 70 on the cover 68 bottom edge to attach the cover to the member 74. The member 74 has a bottom wall 76 with an L-shaped opening 20, FIG. 2, providing access to compartment 64 through which the bolt 6 is passed through.

The cover 68 and the walls 76, 82, 84, 86 and 88 of the housing 16 form an interior cavity 90 which is divided into central bolt receiving compartment 64 and outer compartments 91, 92 on either side of compartment 64 and chamber 69. Upper chamber 69, FIG. 5, communicates between compartments 91 and 92 adjacent to the cover 68. Chamber 69 is formed by the cover 68 and the top wall 110 of central compartment 64. Compartment 64 is formed by walls w, FIG. 3. Compartment 64 divides the cavity 90 into the compartments 91 and 92 and chamber 69. The walls w of compartment 64 form an L-shaped box-like structure which define the shape of compartment 64 located within cavity 90.

The walls w of the compartment 64, FIGS. 5, 5*a*, and 8, and as best seen in FIGS. 5*a* and 8, include a top wall 110 and side walls 112, 114. Wall 114 is continuous with spaced apart walls 116 and 118, FIG. 8, which form compartment 120 within compartment 64. The walls 112 and 116 form a continuous compartment 64 with walls 112 and 114. Walls 112 and 118, FIG. 5, are molded integral and one piece with the bottom wall 76. The wall 116 is of shorter height than walls 112 and 118 and depends from top wall 110. Wall 116 terminates spaced from the plane of the bottom wall 76 so that compartments 120 and 64 communicate adjacent to bottom cover 102, FIG. 5.

The walls 112, 116, FIG. 8, have slots for receiving the ring contacts 56, 58. A portion of the contacts 56, 58 extends into the compartment 120. The chamber 69 between the top wall 110, FIG. 5*a*, and the cover 68 is part of cavity 90 which includes the compartments 91 and 92. The compartments 91 and 92 with communicate with each other by way of chamber 69 forming a single\cavity 90.

The battery 108, FIG. 5, is located in compartment 91 and the depending portion board 54' of the circuit board 54 depends into compartment 92. The housing 16 has ribs 122 for supporting the battery 108, FIGS. 5, 5*a*. The compartment 92 has ribs 124 for supporting the board 54'. The top wall 110, FIG. 6, has inclined ribs 126 for guiding the bolt 10 during insertion into the housing aperture 49. The pins 98, 100 are permanently molded fixed to the top wall 110, FIG. 5, with their collars 104, 104' (FIG. 9) abutting the outer surface of the top wall 110. The pins 98, 100 fit in holes 111, FIG. 5*a*, in the top wall 110, and may be molded to the top wall as the housing member 74 is formed or inserted into the holes 111 later as desired. The walls 110, 112 and 118 forming the compartment 64 divide the housing 16 cavity 90 into the three compartments 64, 91, 92, FIG. 5*a*, and chamber 69, FIG. 5*a*. The top wall 110 lies in approximately the plane of the recesses 83 of the housing member 74 side walls upper edges, FIG. 5*a*. In FIG. 9, the pins 98, 100 have respective shanks 105, 105' on one side of the collars 104, 104' and respective smaller diameter tip portions 106, 106' on the side of the collars opposite the shanks.

In FIGS. 11*a*, 11*b* and 11*c*, representative contact 56 is shown. Contact 56 comprises a planar sheet metal ring 128, which may be the metal discussed above, having a elongated rectangular leg 130 extending from the edge of the ring. The leg 130 has a lip 132 that is bent at right angles thereto. The lip 132 has a hole 134. The ring 128 defines an inner circular cylindrical opening 136. Three like dimensioned contacts 138 are bent from the sheet metal forming the ring 128. The contacts are bent at an angle to the plane of the ring 128 such that the contacts are resilient and can flex in directions 140 relative to the plane of the ring 128. The contacts terminate in lips 140 which are bent at an angle to the plane of the contacts 138. A metal wire 144 has a portion passed through the hole 134 of the lip 132 of each of the contacts 56, 58 and soldered to the lip. The wire 144 has a loop 146 at its extended end. The loop 146 is attached to a corresponding one of the pins 98, 100, FIG. 8, by soldering or other method to form an electrically conductive connection to the pins.

In FIG. 11*c*, the lips 140 define a circular aperture that is smaller than the diameter of the bolt shank passing therethrough, FIGS. 12 and 13. The bare shank portion 14, FIG. 12, resiliently slidably and ohmically engages the lips of contact 58. The lips of contact 56 engage the electrically conductive layer 42 in sliding resilient ohmic engagement. The sliding engagement minimizes damage to the layer 42 and to the surface of the shank portion 14.

Top wall 110, FIG. 9, has three upstanding molded plastic stanchions 94, one being shown in this figure. Printed circuit board assembly 52 is attached to the stanchions 94, FIG. 5. The assembly 52 comprises a main circuit board 54 and an auxiliary printed circuit board 54' attached normal to the main board 54. The printed circuit board 54 is supported by the three stanchions 94 in space 95 of the housing 16. The auxiliary circuit board 54' depends from board 54 into compartment 92, FIG. 5. The pins 98 and 100 attached to wall 110 are soldered (not shown) to the mating contact pads (not shown) on the board 54 of the assembly 52. The battery 108 is also attached to board 54 and electrically coupled to its circuit to power the circuit. As noted, the battery does not power up the circuit until the bolt is inserted and engaged therewith via contacts 56, 58.

A representative pin 98 is shown in FIG. 4. Pin 98 is cylindrical metal having an annular collar 104, an elongated shank 105 terminating at the collar 104 and a narrower extension 106 extending from the collar 104 opposite the shank 105. The loop 146, FIG. 11*c*, is soldered to the end portion of the shank 105, FIG. 9.

A bottom cover 102 encloses the compartment 64 and is attached to the bottom wall 76 by snap fit devices molded into in the cover 102 and bottom wall 76. The bottom cover 102 is complementary to the opening 20' to the compartment 64. The bottom cover as is all of the housing 16 and top cover 68 comprise molded thermoplastic material.

The bottom cover, FIG. 10 has inclined ribs 148 which cooperate with ribs 126 in the top wall 110, FIG. 6, to form a tapering egress opening for receiving, guiding and aligning the bolt 10 during insertion with the grommet 60 and the contacts 56, 58. This guiding action aligns the bolt 10 tip portion 14, FIG. 13, with the opening 136 in the ring contacts, FIG. 11*a* and the opening in the grommet 60. Slots 150 and 152, FIG. 10, are formed in the cover 102 to receive the mating ring contacts 56, 58, FIG. 6.

When the shank 14 is received in the module 4, the shank of the bolt 6 makes electrical ohmic connection with the contacts 56, 58. This arms the circuit. Subsequent interruption of a signal in the circuit by breaking the conductor path formed by the bolt 6 is sensed by the circuit in a sensor portion. This changes the codes in the circuit and causes the generation of a "tamper" signal, i.e., a second code. The tamper signal may be the word "tamper" which is generated and transmitted instead of the normal signal or first code. Power is supplied to the circuit after the bolt is inserted by closure of the engaged contacts 56, 58 by the bolt 6.

The circuit of board 54, FIGS. 8, 12 and 15, may include a programmable RFID tag circuit, FIGS. 18 and 19, including a controller such as controller 240' or 253', comprising a CPU and memory, e.g., an EPROM, an electronically programmable ROM, which may be programmed by a programming arrangement (not shown) and other memory such as a ROM and so on as shown in FIG. 18. The circuit may include the circuit elements of the circuit of FIG. 18 and further including the programmable EPROM. The circuit includes a transmitter 244' and a transmission antenna 234' . The transmitter 244', once energized by the insertion of the bolt at 251', FIG. 19, may according to its program, transmit the encoded signal intermittently at random time intervals, for example, in the range of 1-10 seconds, and which may be conventional, or other periods. The circuit includes a programmable arrangement for programming a given ID, a first code or normal signal.

Once the circuit is energized, the circuit of FIG. 19 may be programmed to begin transmission of the data, previously programmed into the circuit, via a transmitter or, in the alternative, selectively in response to interrogation in a different embodiment. This data includes a first code generated by generator 256' manifesting the serial number of the seal module 4 and other data noted above. This data preferably is transmitted periodically every few seconds at random intervals, for example, or upon interrogation, in the alternative. The battery 108, FIG. 8, may be permanent and has a life sufficient for this purpose for the anticipated life of the seal module 4.

In FIG. 19, in electronic system 248' that includes a circuit 252', a locking bolt at 251' is inserted into the seal housing 16 (FIG. 1). This activates the controller 253' (a microprocessor) of the circuit 252', which causes the first code signal generator 256' to generate a first code manifesting a locked seal module 4 (FIG. 1). The transmitter 258' through the controller 253' transmits the generated first code by generator 256' to a reader 250', which may be conventional. The reader includes an antenna, a receiver and a circuit for decoding the received signal and converting it to the desired data for further transmission or display.

If the circuit is interrupted by severing the bolt 6 and/or the electrically conductive coating 42, FIG. 12, the circuit 252' immediately senses this condition. Electrical power is applied to the circuit 252' at all times while the bolt is inserted. The circuit 252' will transmit periodically automatically as programmed in the controller 253' or, in the alternative in a different embodiment, upon interrogation, transmit via transmitter 258', FIG. 19, a new code manifesting a bolt tampered condition 259' to the reader 250'.

The interruption of the circuit 252' by a tampered bolt 259' is sensed by the controller 253' which immediately causes the generation of the second code by generator 260' and disables the first code generator 256'. Reader 250' reads the seal data transmitted by transmitter 258' under control of the controller 253'.

The program of circuit 252', FIG. 19, in response to momentary interruption of power, or interruption of the circuit 252' by severing the bolt, is programmed to transmit the message "tampered." The reader 250', which may be hand held or permanently installed, adjacent to a conveyer of the cargo container or roadway for a trailer truck, receives the transmitted signal. The reader 250' is coupled to a local, but remote computer (not shown). The tampered signal from the reader is forwarded to the computer which also indicates this state with a display and may be programmed to set off an audible and/or visual alarm also or in the alternative. This alarm is immediate and the transmitted signal immediately identifies the seal and the container that has been tampered with. The tampering is noted at a given container/truck location by reading the transmitted signal at different shipping and receiving points, or by a GPS system discussed below in connection with FIG. 20. The GPS system determines the location of the seal by conventional GPS technology. The tampered state of the seal and its location at which it is tampered with is communicated to a central communication center. This information is communicated by conventional cellular phone technology as discussed below in connection with FIG. 20.

In FIG. 15, a bolt 6' substantially the same as bolt 6 is shown. The difference is that the head 10' comprises a separate piece 152 that is press fitted onto the shank 12'. The tip portion 14 also shows the annular groove 154 used to mate with the locking device 8 ring 26. The metal coating 42' is applied to the shank 12' at the head region as a continuous layer 156 in the head region. When the piece 152 is assembled, it is assembled over and in contact with the layer 156.

In operation, in FIG. 1, when the locked bolt 6 is to be removed, its shank is severed at collar 34. This permits the remaining piece of the bolt 6 shank 12 to be retracted from within and through the module 4 interior compartment 64 and removed from the hasp 9,9'. The relatively low cost retracted bolt 6 shank 12 and the severed tip portion 14 with the locking device 8 are discarded and the relatively more costly module 4 with its internal electronics can then be reused with another new bolt and locking device.

In FIG. 16, in a further embodiment, a bolt 230 is locked to module 4 by a key operated padlock 232. In FIGS. 16 and 17, the bolt 230 has a construction similar to that of the bolt 6' of FIG. 15. The difference is that groove 154 of the bolt 6' is widened into groove 234, FIG. 17. This widened groove is arranged to receive a key operated reciprocating locking element (not shown) of a padlock 232. Such a key operated padlock is shown for example in U.S. Pat. No. 6,778,083, incorporated by reference herein. In lock 232, the locking element (not shown) is reciprocated into and out of the groove 234 by operation of a conventional key (not shown) inserted into the key hole 236. In this case, the removal of the lock 232 permits the bolt to be removed from the module 4 which can then be reused intact with that bolt and padlock or another padlock with a different key, if desired.

In operation, the insertion of the bolt of any of the disclosed embodiments, which forms a portion of the circuit 252' completing that circuit by electrically conductively connecting the contacts 56, 58, powering the circuit 248', FIG. 19, via the battery 108, FIGS. 2 and 3, and activating the circuit 248'. A signal is applied to and passes through the bolt conductor of any of the disclosed embodiments to and from the circuit 248'. This circuit is programmed to sense the presence of this signal to show the tamper state of the seal which when powered on initially will not indicate a tamper condition but a "good" condition which may be manifested by a green light (not shown) for example. The circuit, once powered on, is armed and will transmit the programmed seal identification and related data to a local interrogator/receiver (not shown) upon interrogation.

Assume the bolt shank is severed in order to open the seal 2, FIG. 1, or the tamper indicating seal of some of the embodiments or the module 4 is removed as in others of the embodiments such that the bolt can be removed from the seal module 4. The severed bolt conductor or the disconnection of the contacts 56, 58 with the bolt of the various embodiments indicates an unlocked condition. The severing of the conductor or unlocked condition interrupts the signal supplied to and from the circuit 248', FIG. 19. The circuit program senses this interruption and is programmed to change the programming to note the tampered condition which may also be indicated by a red light (not shown) on the module. This condition is transmitted by transmitting the word "tamper" and/or a change in serial number and/or an alarm condition. When the alarm condition is read by reader 250', the integrity of that container has been breached. The reader 250' also stores the seal number of each seal that has been breached. This information is manually read from the reader 250'.

If an attempt is made to pull the bolt out of the seal 2 and reprogram the circuit and then reinsert the bolt, the circuit 248' senses this and transmits the word "tamper." Any attempt to cut or sever the bolt and its conductor or otherwise open the bolt and remove it from the seal module 4 causes a "tamper" signal to be generated. The tamper signal is repetitively transmitted. Thus it is important that no interruption of the circuit occurs once the circuit is powered on and armed.

Thus it is important that the contacts 56, 58, FIG. 12, be arranged to provide positive ohmic connection to preclude any accidental interruption of power or signal to the circuit 121. It is important that the contacts not disengage due to shock loads such as dropping and rough handling of the attached container. Contacts 56, 58 withstand such shock loading.

The contact arrangements may differ from the disclosed embodiments. Also, the bolts that are shown made of metal may be non-electrically conductive plastic or similar material, or the bolts may be made of electrically conductive plastic, hard rubber or other similar electrically conductive non-steel, non-metal shank material or any combination of such materials. Depending upon the environment in which the seal is used locking devices and/or bolts of any degree of high, robust security or lower level, low security, or any degree therebetween, may be employed.

The tamper signal may comprise any suitable signal recognized as a tampered condition and transmission of the word "tamper" is given by way of illustration. In the claims, the term "locking device" is intended to include any kind of tamper evident device or security seal such as padlock or strap seals using metal or plastic tang devices or temporary seal devices that are disposable, or locking devices that permanently secure hasps and must be destroyed to open.

In FIG. 20, a seal status monitoring, tracking and communications system 280 for the seal 2 of FIG. 1 monitors, tracks and communicates the position and tampered status of the seal 2 via a cellular telephone communications network. The network comprises a cellular phone communications unit 288, an optional cellular phone tracking system 296, cellular towers 292 and a cellular phone communications center 290. In the alternative to the cellular tracking system, the tracking system may employ GPS technology. In this system, GPS satellites 282 communicate to an optional GPS receiving unit 284. The GPS receiving unit 284 transmits the GPS seal location data to the microprocessor and memory of controller 253', circuit portion 252', FIG. 19. Memory (not shown) in the circuit 252' stores the data generated by the various systems. This stored data is retrieved by the controller 253'.

Power supply 286 powers the controller 253' (FIG. 19), the GPS receiving unit 284 and the cellular phone communications unit 288. The communications unit 288 communicates with the communications center 290 through cellular towers 292 and transmits either the tracking data generated by cellular technology from system 296 or GPS technology from unit 284. The controller 253', FIG. 19, determines whether the GPS or cellular technology is utilized for tracking the seal 2. This determination may be programmed into the circuit 252' memory (not shown) or made by specific instructions communicated to the circuit 252', for example, via the communications center 290 or by other communication arrangements as may be established or desired.

When the mobile communication system comprises a GSM mobile communication system, the communications unit 288 is a GSM communication module to permit the communication unit 288 to communicate pertinent data to the communications center 290 via telephone cellular technology. The communications center 290 may not always be able to receive the data if turned off or interfered with, but can receive the data from nearby towers 292 when the center 290 is turned on or the interference removed and so on. The communications unit 288 may be a GSM communications module used in mobile phone systems such as GR47/48 provided by Sony-Ericsson Company.

In a GPS mode, the controller 253', FIG. 19, receives and processes signals from the GPS receiving unit 284, FIG. 20, and also actuates the communications unit 288 to transmit seal status-related data to the communications center 290 via the towers 292. The status related data includes the position and the tampered/normal status of the seal 2 at a given time.

As an option, the monitoring, tracking and communications system 280 can monitor the environment around the seal such as temperature, humidity and so on and also communicate this data. The data can also be recorded if desired by a recording system (not shown). If the seal is tampered with, the monitoring circuit portion 252' detects this status via periodic monitoring of the seal, e.g., every few seconds or minutes, or any desired time interval according to a given need, and communicates this information to the communications center 290. When not communicating the data, the system is in a sleep standby mode to conserve electrical energy.

The circuit portion 252', FIG. 19, also may receive interrogation requests and transmit status data upon receipt of such a request, either through a conventional RFID interrogator as shown in FIG. 18 or by cell phone communication. Periodic status monitoring may be programmed into the circuit portion 252' or instructed by a given set of instructions communicated to the circuit portion 252' to any desired time interval according to a given set of circumstances of a particular seal. The monitoring, tracking and communications system 280, FIG. 20, can also monitor the power level of the supply 286 to take action when the power level gets sufficiently low to warrant corrective action, which action may comprise replacement of the power supply and be taken by personnel in charge of the container/seal upon communicated instructions. In the alternative, other systems may be used for communications such as those discussed in the introductory portion regarding the Arguin publication and other related or similar known GPS and cellular phone communication systems.

The cellular phone tracking system 296 may be employed optionally instead of the GPs system unit 284 as a seal 2 tracking system. The cell phone tracking system 296 may be a commercially available system provided by a wireless positioning system. This system is described in the Navizon web site at www.navizon.com. This system uses Wi-Fi access points, such as points 298, FIG. 20, for example, that may comprise wireless routers, or other systems, that provide wireless access to the internet, and cell phone tower signals from cellular towers 292, FIG. 20, to determine the exact location of the Wi-Fi access points and cell towers. These access points and cell towers are mapped by users with GPS enabled devices such as mobile phones having GPS capabilities referred to as "smart" phones such as the Apple iPhone and others.

The cell phone location data is collected by such users as they pass near the towers or access points, entered into the Navizon data base by them and thus may later be shared by other Navizon users. As a user's cell phone passes in the vicinity of a cell phone tower or Wi Fi access point, the tower's or the Wi Fi's location is determined by the user's GPS enabled phone and the data is entered into the Navizon data base for use by all Navizon users. The system 296 normally tracks the location of a mobile phone. In FIG. 20, this cell phone tracking technology is used to track the position of the seal incorporating this technology into its circuitry.

The location of a mobile phone and thus the seal is determined by well known triangulation techniques. The system does not require GPS to be enabled on a mobile device, but simulates virtual GPS on the device providing real time location information, which is stored in the circuit 252' memory portion of the controller 253', FIG. 19. This information is then communicated from the controller 253' to the communications center 290 monitoring the seal 2 status. The seal 2 status is also communicated to the communications center 290 as well as the seal's location.

The tracking system 296 requires that the cell towers associated with the seal location are within the system's data base of mapped towers. Thus selected ones of the users of the system with GPS activated mobile phones participate in mapping the cell towers, and other cell phones, without GPS, and in the instant case, the seal, utilizes the Navizon tracking system for determining its locations from the system 296.

ATT also has an application program that is downloadable to mobile phones. This program displays a map on a mobile phone's display indicating the location of that cell phone without using GPS, but rather cellular towers. Such a system may also be utilized to track the seal if desired, for example.

It will occur to one of ordinary skill that various modifications may be made to the disclosed embodiments given by way of example and not limitation. It is intended that the scope of the invention be defined by the appended claims. The various tracking systems are given by way of example as other systems may be utilized, now known, or later developed. Also, the locking mechanisms, the power source, the bolt configuration, the information stored and transmitted, the use of a movable door and a transparent housing may be changed according to a given implementation.

What is claimed is:

1. An electronic security bolt seal with a reusable electronics module for locking a hasp comprising:

an electronics circuit having first and second portions;

an electronic module comprising a housing having a cavity, the first portion of the electronics circuit being entirely in the cavity for monitoring a tamper status of the seal;

a bolt having a head and an elongated shank engaged with the housing cavity, the bolt including the second portion of the electronics circuit engaged with the first portion of the electronics circuit, the bolt for carrying a current from and to the first portion of the electronics circuit for completing the electronics circuit and for engaging the hasp to be locked;

the bolt and module being arranged such that the bolt passes through the module;

a bolt locking device engaged with and locked to a tip region of the bolt that protrudes from the module to secure the module to the bolt in a locked state and to lock the bolt to the hasp, wherein the bolt locking device includes a thermoplastic shell with a collar that spans between a locking body and the housing of the electronic module for preventing the electronic module from moving along the elongated shank of the bolt;

a conical sealing element on the bolt forming a tapered region surrounding the bolt;

the module housing having a first inlet aperture for receiving the bolt, the bolt for extending through the cavity in the locked state;

the tapered region being engaged with the first inlet aperture forming a contamination sealing arrangement for sealing the module housing cavity from ambient region contamination in the locked state;

the locked state for locking the tapered region so as to seal the first inlet aperture;

wherein when the bolt is in the locked state, the electronics circuit senses the integrity of the bolt, manifesting the seal tamper status, and the bolt has an exposed region external to the module for selective severing of the bolt at the exposed region to interrupt the electronics circuit second portion while unlocking the seal from the hasp and releasing the module from the bolt for subsequent reuse of the module;

a tracking and communications system employing the electronics circuit first portion attached to the module for communicating the seal tamper status and the seal's position to a communications center.

2. The electronic security bolt seal of claim 1 wherein the tracking and communications system comprises a GPS system comprising a GPS receiving unit coupled to the electronics circuit first portion for receiving and processing seal positioning signals from GPS satellites.

3. The electronic security bolt seal of claim 1 wherein the tracking and communications system comprises a cellular phone communications unit coupled to the electronics circuit first portion and which unit communicates with the communications center via cellular towers.

4. The electronic security bolt seal of claim 1 wherein the tracking and communications system detects and tracks the geographic position of the seal via a cellular phone tracking system coupled to the electronics circuit first portion, the tracking and communications system comprising a cellular phone communications unit which sends seal tamper status data from the electronics circuit first portion and seal tracking data from the tracking system to the communications center via the communication unit and cellular towers.

5. The electronic security bolt seal of claim 1 wherein the seal tracking and communications system comprises a GPS tracking system and a cellular phone tracking system coupled to the electronics circuit first portion and a controller for selecting one of the GPS and cellular phone tracking systems to track the position of the seal.

6. The electronic security bolt seal of claim 5 wherein the tracking and communications system includes a cellular phone communications unit for communicating to the communications center via cellular towers.

7. The electronic security bolt seal of claim 1 wherein the seal tracking and communications system comprises a cellular phone tracking system coupled to the electronics circuit first portion, the cellular phone tracking system comprising an electronic arrangement for inputting cellular tower location data identifying the location of each of a plurality of towers adjacent to the seal for computing the location of the seal by triangulation computation of the inputted plurality of tower location data.

8. The electronic security bolt seal of claim 1 wherein the seal tracking and communications system comprises a cellular phone tracking system coupled to the electronics circuit first portion, the cellular phone tracking system comprising an electronic arrangement for inputting Wi Fi access points location data identifying the location of each of a plurality of Wi Fi access points adjacent to the seal for computing the location of the seal by triangulation computation of the inputted plurality of access points location data.

9. The electronic security bolt seal of claim 1 wherein the seal tracking and communications system comprises a cellular phone tracking system coupled to the electronics circuit first portion, the cellular phone tracking system comprising an electronic arrangement for inputting Wi Fi access points and cellular tower locations data identifying the location of each of a plurality of towers and Wi Fi access points adjacent to the seal for computing the location of the seal by triangulation computation of the inputted plurality of tower locations or Wi Fi access points data.

10. The electronic security bolt seal of claim 1 wherein the tracking and communications system comprises a GPS system comprising a GPS receiving unit coupled to the electronics circuit first portion for receiving seal positioning signals from GPS satellites, the electronics circuit first portion for processing the received GPS positioning signals to track the position of the seal.

11. The electronic security bolt seal of claim 1 wherein the bolt includes first and second electrically conductive members in electrical contact with each other at one region of the bolt and in electrical isolation from each other in a further bolt region forming the second circuit portion and ohmically engaging the electronics circuit first portion to form a circuit path to the electronics circuit first portion.

12. The electronic security bolt seal of claim 1 wherein the first and second circuit portions of the electronics circuit comprise mating electrical contacts, the tapered region for aligning the contacts when the bolt is in the locked state.

13. The electronic security bolt seal of claim 1 wherein the tip region and the locking device are arranged to lock the locking device to the tip region, and wherein the cavity in the housing includes an egress aperture that has a contamination sealing arrangement around the elongated shank of the bolt for sealing the module cavity from contamination from the ambient region.

14. The electronic security bolt seal of claim 1 wherein the bolt is dimensioned to pass through the housing in a compartment in the cavity from the first inlet aperture and egress the housing at a second aperture, the tip region of the bolt protruding from the housing through the second aperture, the tip region and the locking device being arranged to lock the locking device to the tip region, and wherein a contamination sealing arrangement includes a grommet on the housing at the second aperture and the conical sealing element on the bolt which seals the first inlet aperture when the bolt is in the locked state, the grommet and the conical sealing element together sealing an interior of the module from ambient external contamination.

15. The electronic security bolt seal of claim 1 wherein the housing has a sealing element for engaging the tip region and sealing the cavity at the tip region.

16. The electronic security bolt seal of claim 1 wherein tapered region of the conical sealing element surrounds the bolt at a location intermediate the bolt head and the tip region of the bolt, the housing having a second sealing element for engaging the bolt at the tip region, the module being secured in a region that is generally between the conical sealing element and the second sealing element.

17. An electronics security bolt seal for locking a hasp, said electronics security bolt seal comprising:

a reusable electronic module having an electronics circuit and a housing that includes a cavity, wherein a first portion of the electronics circuit is disposed entirely in the cavity for monitoring a tamper status of the seal;

a tracking and communications system at least partially contained in the housing that employs the first portion of the electronics circuit and wirelessly communicates the tamper status and a locational position of the seal to a communications center;

a bolt having a head and an elongated shank that engages and passes through the cavity of the housing for engaging the hasp between the head and the housing, wherein the elongated shank engages a pair of electrical contacts on the first portion of the electronics circuit when the bolt is engaged in a locked state in the cavity, and wherein the elongated shank includes a conical element surrounding the bolt that engages an inlet aperture of the housing in the locked state for preventing further insertion of the elongated shank into the cavity and contamination in the cavity from an ambient region outside the housing;

a bolt locking device having a locking body engaged with and locked to a tip portion of the elongated shank protruding from the cavity of the housing opposite the head to secure the bolt in the locked state;

a thermoplastic collar that surrounds the elongated shank and is disposed between the locking body and the housing of the electronic module to prevent the electronic module from moving along the elongated shank of bolt, wherein the thermoplastic collar provides an exposed region of the bolt that is configured to be severed; and wherein, when the bolt is in the locked state, the electronics circuit senses the integrity of the bolt and manifests the seal tamper status, wherein the electronics circuit generates a tamper signal when the first portion is interrupted by the bolt being severed or removed from the housing to unlock and release the seal from the hasp.

18. The electronic security bolt seal of claim 17, wherein, when the bolt is engaged in the locked state in the cavity, the first and second electrically conductive portions respectively engage spaced apart first and second electrical contacts on the first portion of the electronics circuit.

* * * * *